US012781142B2

(12) United States Patent
Koseoglu et al.

(10) Patent No.: US 12,781,142 B2
(45) Date of Patent: Nov. 3, 2026

(54) HYDRODEARYLATION OF AROMATIC BOTTOMS TO PRODUCE BTEX AND AROMATIC SOLVENT

(71) Applicant: Saudi Arabian Oil Company, Dhahran (SA)

(72) Inventors: Omer Refa Koseoglu, Istanbul (TR); Robert Peter Hodgkins, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 199 days.

(21) Appl. No.: 18/752,440

(22) Filed: Jun. 24, 2024

(65) Prior Publication Data

US 2025/0388825 A1 Dec. 25, 2025

(51) Int. Cl.
*C10G 63/02* (2006.01)

(52) U.S. Cl.
CPC ..... *C10G 63/02* (2013.01); *C10G 2300/1044* (2013.01); *C10G 2300/4006* (2013.01); *C10G 2300/4012* (2013.01); *C10G 2300/4018* (2013.01); *C10G 2400/30* (2013.01)

(58) Field of Classification Search
CPC ..... C10G 63/02; C10G 2300/4006; C10G 2300/4012; C10G 2300/4018; C10G 2300/1044
See application file for complete search history.

(56) References Cited

U.S. PATENT DOCUMENTS

| | | | |
|---|---|---|---|
| 2,301,391 | A | 11/1942 | Frey |
| 2,373,501 | A | 4/1945 | Dewey |
| 2,389,713 | A | 11/1945 | Atwell |
| 2,697,684 | A | 12/1954 | Hemminger et al. |
| 2,836,632 | A | 5/1958 | Fetterly |
| 2,881,226 | A | 4/1959 | Wadsworth |
| 2,885,452 | A | 5/1959 | Louis |
| 2,954,413 | A | 9/1960 | Hugo et al. |
| 3,053,760 | A | 9/1962 | Henke et al. |
| 3,062,903 | A | 11/1962 | Odioso et al. |
| 3,067,128 | A | 12/1962 | Kimberlin et al. |
| 3,075,022 | A | 1/1963 | Gammon et al. |
| 3,116,345 | A | 12/1963 | Slaymaker |
| 3,145,238 | A | 8/1964 | Kestner |
| 3,159,565 | A | 12/1964 | Kimberlin et al. |
| 3,172,842 | A | 3/1965 | Paterson et al. |
| 3,197,518 | A | 7/1965 | Chapman et al. |
| 3,204,007 | A | 8/1965 | Taro et al. |
| 3,252,888 | A | 5/1966 | Langer et al. |

(Continued)

FOREIGN PATENT DOCUMENTS

| | | | |
|---|---|---|---|
| CA | 1137118 | A | 12/1982 |
| CA | 1168647 | A | 6/1984 |

(Continued)

*Primary Examiner* — Ellen M McAvoy
*Assistant Examiner* — Ming Cheung Po
(74) *Attorney, Agent, or Firm* — Leason Ellis LLP

(57) ABSTRACT

A process for treatment of $C_9$+ aromatic complex bottoms feedstream that includes reacting the feedstream in the presence of a hydrodearylation catalyst and hydrogen under specified reaction conditions for hydrodearylation to produce liquid effluents containing dearylated hydrocarbons and separating the liquid effluents into a BTEX-rich fraction and a solvent fraction, and recovering the solvent fraction.

18 Claims, 4 Drawing Sheets

(56) References Cited

U.S. PATENT DOCUMENTS 3,373,217 A 3/1968 Engelbrecht et al.
3,435,084 A 3/1969 Cabbage et al.
3,441,625 A 4/1969 Bargeron et al.
3,485,883 A 12/1969 Engelbrecht et al.
3,557,234 A 1/1971 Henry et al.
3,557,235 A 1/1971 Henry et al.
3,591,651 A 7/1971 Carr et al.
3,595,933 A 7/1971 Feldman et al.
3,617,494 A 11/1971 Montgomery
3,624,172 A 11/1971 Adams
3,625,879 A 12/1971 Horne et al.
3,649,520 A 3/1972 Graven
3,702,292 A 11/1972 Burich
3,723,256 A 3/1973 Thompson
3,795,608 A 3/1974 Fujiyama et al.
3,836,344 A 9/1974 Maslyk et al.
3,933,619 A 1/1976 Kozlowski
3,939,221 A 2/1976 Pearce
3,957,621 A 5/1976 Bonacci et al.
4,022,681 A 5/1977 Sheng et al.
4,031,154 A 6/1977 Edison et al.
4,066,531 A 1/1978 Owen et al.
4,070,408 A 1/1978 Vickers
4,078,990 A 3/1978 Brennan et al.
4,127,471 A 11/1978 Suggitt et al.
4,192,961 A 3/1980 Polyakov et al.
4,203,826 A 5/1980 Mayes
4,211,886 A 7/1980 Tabak et al.
4,222,854 A 9/1980 Vorhis et al.
4,242,531 A 12/1980 Carter
4,244,808 A 1/1981 Lang et al.
4,300,008 A 11/1981 McCaulay
4,324,935 A 4/1982 Wernicke et al.
4,382,851 A 5/1983 Angevine et al.
4,484,016 A 11/1984 Maschmeyer et al.
4,532,370 A 7/1985 Quan et al.
4,538,018 A 8/1985 Carter
4,645,585 A 2/1987 White
4,747,933 A 5/1988 Hibbs
4,806,700 A 2/1989 Martindale
4,831,208 A 5/1989 Zarchy
4,923,589 A 5/1990 Dalson
5,004,853 A 4/1991 Barger et al.
5,026,931 A 6/1991 Agreda et al.
5,149,894 A 9/1992 Holtermann et al.
5,189,233 A 2/1993 Larkin et al.
5,210,333 A 5/1993 Bellows et al.
5,294,334 A 3/1994 Kaul et al.
5,382,734 A 1/1995 Sardar et al.
5,773,670 A 6/1998 Gildert et al.
5,830,345 A 11/1998 Lee et al.
5,856,602 A 1/1999 Gildert et al.
5,871,618 A 2/1999 Lee et al.
5,877,385 A 3/1999 Lee et al.
6,187,980 B1 2/2001 Gildert
6,187,987 B1 2/2001 Chin et al.
6,281,398 B1 8/2001 Belloir et al.
6,375,802 B1 4/2002 Gentry et al.
6,448,436 B1 9/2002 Kreitman et al.
6,616,831 B1 9/2003 Gentry et al.
6,740,788 B1 5/2004 Maher et al.
6,787,025 B2 9/2004 Mukherjee et al.
6,958,425 B1 10/2005 Bogdan et al.
7,091,390 B2 8/2006 Jan et al.
7,271,303 B1 9/2007 Sechrist et al.
7,358,411 B2 4/2008 Murray et al.
7,507,325 B2 3/2009 Gueret et al.
7,638,667 B2 12/2009 Jan et al.
7,687,423 B2 3/2010 Moscoso et al.
7,723,554 B2 5/2010 Arca et al.
7,745,678 B2 6/2010 Jan et al.
7,880,045 B2 2/2011 Arca et al.
7,964,763 B2 6/2011 Dixon et al.
8,168,844 B2 5/2012 Arca et al.
8,536,397 B2 9/2013 Noll et al.
8,927,800 B2 1/2015 Mahieux et al.
8,932,451 B2 1/2015 Strauss et al.
8,975,462 B2 3/2015 Kim et al.
9,061,953 B2 6/2015 Johnson et al.
9,090,521 B2 7/2015 Al-Haji
9,109,169 B2 8/2015 Al-Therwi et al.
9,145,522 B2 9/2015 Negiz et al.
9,221,036 B2 12/2015 Koseoglu et al.
9,221,729 B1 12/2015 Lee
9,283,553 B2 3/2016 Kim et al.
9,328,299 B2 5/2016 Funk et al.
9,382,173 B2 7/2016 Yanagawa et al.
9,862,898 B2 1/2018 Ward et al.
9,909,075 B2 3/2018 Klein et al.
10,006,821 B1 6/2018 Boger
10,053,401 B1 8/2018 Beadle et al.
10,093,873 B2 10/2018 Koseoglu et al.
10,508,066 B2 12/2019 Koseoglu et al.
10,759,723 B2 9/2020 Koseoglu et al.
10,844,295 B1 11/2020 Koseoglu et al.
10,899,685 B1 1/2021 Koseoglu et al.
10,934,495 B2 3/2021 Koseoglu et al.
10,968,396 B1 4/2021 Koseoglu et al.
11,040,926 B2 6/2021 Pandey et al.
11,046,898 B1 6/2021 Koseoglu et al.
11,046,899 B2 6/2021 Hodgkins et al.
11,066,344 B2 7/2021 Koseoglu et al.
11,066,609 B2 7/2021 Koseoglu et al.
11,066,610 B2 7/2021 Koseoglu et al.
11,104,851 B2 8/2021 Koseoglu et al.
11,110,428 B2 9/2021 Koseoglu et al.
11,149,220 B2 10/2021 Hodgkins et al.
11,154,845 B1 10/2021 Koseoglu et al.
11,162,039 B1 11/2021 Koseoglu et al.
11,168,266 B2 11/2021 Koseoglu et al.
11,168,269 B2 11/2021 Koseoglu
11,214,745 B1 1/2022 Koseoglu et al.
11,248,173 B2 2/2022 Koseoglu et al.
11,248,176 B2 2/2022 Hodgkins et al.
11,267,769 B2 3/2022 Koseoglu et al.
11,268,037 B2 3/2022 Koseoglu et al.
11,274,068 B2 3/2022 Koseoglu et al.
11,279,663 B2 3/2022 Koseoglu et al.
11,279,888 B2 3/2022 Hodgkins et al.
11,332,678 B2 5/2022 Koseoglu et al.
11,359,148 B2 6/2022 Koseoglu et al.
11,370,973 B2 6/2022 Koseoglu et al.
11,390,816 B2 7/2022 Choi et al.
11,420,192 B2 8/2022 Koseoglu et al.
11,465,950 B2 10/2022 Jin et al.
11,473,022 B2 10/2022 Koseoglu et al.
11,548,842 B1 1/2023 Koseoglu et al.
11,572,517 B2 2/2023 Harale et al.
11,578,016 B1 2/2023 Solami et al.
11,613,714 B2 3/2023 Koseoglu et al.
11,617,981 B1 4/2023 Younes et al.
11,618,858 B1 4/2023 Koseoglu et al.
11,673,845 B2 6/2023 Qureshi et al.
11,718,575 B2 8/2023 Solami et al.
11,787,759 B2 10/2023 Solami et al.
11,820,949 B2 11/2023 Koseoglu
11,884,888 B2 1/2024 Koseoglu
2001/0001448 A1 5/2001 Kapoor et al.
2007/0203377 A1 8/2007 Arca et al.
2009/0272672 A1 11/2009 Arca et al.
2013/0006027 A1 1/2013 Yanagawa et al.
2013/0144097 A1 6/2013 Bender et al.
2013/0178673 A1 7/2013 Kim et al.
2013/0240406 A1 9/2013 Sadler et al.
2015/0166435 A1 6/2015 Serban et al.
2015/0251973 A1 9/2015 Tinger et al.
2015/0299069 A1 10/2015 Azam et al.
2015/0299086 A1 10/2015 Farha et al.
2016/0045841 A1 2/2016 Kaplan et al.
2017/0009156 A1 1/2017 Pelaez
2018/0066197 A1 3/2018 Koseoglu et al.
2018/0155638 A1 6/2018 Al-Ghamdi et al.
2018/0230070 A1 8/2018 Beadle et al.
2019/0241486 A1 8/2019 Koseoglu et al.

(56) References Cited

U.S. PATENT DOCUMENTS

| | | | | |
|---|---|---|---|---|
| 2020/0062675 | A1* | 2/2020 | Koseoglu | C07C 4/00 |
| 2020/0377806 | A1* | 12/2020 | Koseoglu | C10G 65/10 |
| 2022/0033721 | A1* | 2/2022 | Koseoglu | C10G 59/02 |
| 2022/0389334 | A1 | 12/2022 | Koseoglu et al. | |

FOREIGN PATENT DOCUMENTS

| | | | |
|---|---|---|---|
| CA | 2356632 | A1 | 6/2000 |
| CA | 2570054 | C | 10/2012 |
| CN | 101376823 | A | 3/2009 |
| CN | 102037102 | A | 4/2011 |
| CN | 101687730 | B | 9/2013 |
| CN | 103121895 | B | 6/2015 |
| CN | 105018138 | B | 1/2017 |
| CN | 105001908 | B | 9/2017 |
| EP | 0200654 | A1 | 11/1986 |
| EP | 3901237 | B1 | 9/2023 |
| ES | 2524905 | T3 | 12/2014 |
| FR | 2768724 | A1 | 3/1999 |
| GB | 1279218 | A | 6/1972 |
| GB | 1404776 | A | 9/1975 |
| GB | 2034351 | A | 6/1980 |
| IT | MI20040554 | A1 | 6/2004 |
| JP | 3639243 | B2 | 4/2005 |
| JP | 4126880 | B2 | 7/2008 |
| JP | 5498720 | B2 | 5/2014 |
| JP | 5808614 | B2 | 11/2015 |
| KR | 101797771 | B1 | 12/2017 |
| WO | 1996017039 | A1 | 6/1996 |
| WO | 1999023192 | A1 | 5/1999 |
| WO | 2009008879 | A1 | 1/2009 |
| WO | 2021087163 | A1 | 5/2011 |
| WO | 2012133138 | A1 | 10/2012 |
| WO | 2017116584 | A1 | 7/2017 |
| WO | 2018127812 | A1 | 7/2018 |
| WO | 2021162897 | A1 | 8/2021 |
| WO | 2021162898 | A1 | 8/2021 |
| WO | 2021162899 | A1 | 8/2021 |
| WO | 2022025958 | A1 | 2/2022 |
| WO | 2022025985 | A1 | 2/2022 |
| WO | 2022155192 | A1 | 7/2022 |
| WO | 2022187124 | A1 | 9/2022 |
| WO | 2023064565 | A2 | 4/2023 |
| WO | 2024030747 | A1 | 2/2024 |

* cited by examiner

HYDRODEARYLATION OF AROMATIC BOTTOMS TO PRODUCE BTEX AND AROMATIC SOLVENT

FIELD OF THE DISCLOSURE

The present disclosure relates to the hydrodearylation of aromatic bottoms to produce BTEX and aromatic solvent.

BACKGROUND OF THE DISCLOSURE

In refineries, reformate is typically sent to an aromatic complex (also referred to as an "aromatics recovery complex" or ARC) for extraction of the aromatics. Reformate generally undergoes several processing steps in an aromatic complex to recover high value products including xylenes and benzene. In addition, lower value products, for example toluene, can be converted into higher value products. The aromatics present in reformate are typically separated into different fractions by carbon number, such as $C_6$ benzene, $C_7$ toluene, $C_8$ xylenes and ethylbenzene. The $C_8$ fraction is typically subjected to a processing scheme to produce high value para-xylene. Para-xylene is usually recovered in high purity from the $C_8$ fraction by separating the para-xylene from the ortho-xylene, meta-xylene, and ethylbenzene using selective adsorption or crystallization. The ortho-xylene and meta-xylene remaining from the para-xylene separation are isomerized to produce an equilibrium mixture of xylenes. The ethylbenzene is isomerized into xylenes or is dealkylated to benzene and ethane. The para-xylene is separated from the ortho-xylene and the meta-xylene, typically using adsorption or crystallization. The para-xylene-free stream is recycled to extinction to the isomerization unit, and in the para-xylene recovery unit ortho-xylene and meta-xylene are converted to para-xylene and recovered.

Toluene is recovered as a separate fraction, and then may be converted into higher value products, for example, benzene in addition to or in alternative to xylenes. One toluene conversion process involves the disproportionation of toluene to make benzene and xylenes. Another process involves the hydrodealkylation of toluene to produce benzene. Both toluene disproportionation and toluene hydrodealkylation result in the formation of benzene. With the current and future anticipated environmental regulations involving benzene, it is desirable that the toluene conversion does not result in the formation of significant quantities of benzene.

The aromatic complex produces a reject stream or bottoms stream that is very heavy (typically boiling higher than about 150° C.), which is not suitable as gasoline blending components. For example, maximum sulfur, aromatics, and benzene levels of about 10 ppmw, 35 V %, and 1 V % or less, respectively, have been targeted as goals by regulators.

A problem faced by refinery operators is how to most economically utilize the aromatic complex bottoms. In some refineries, the aromatic complex bottoms are added to the gasoline fraction. However, the aromatic complex bottoms deteriorate the gasoline quality and in the long run impact the engine performance negatively, and any portion not added to the gasoline fraction is considered process reject material. Therefore, a need exists for improved systems and processes for handling aromatic complex bottoms.

SUMMARY OF THE DISCLOSURE

In certain embodiments, a method for treatment of C9+ aromatic complex bottoms obtained from catalytic reforming of naphtha followed by separation in an aromatic complex into a gasoline pool stream, an aromatic products stream and the C9+ aromatic complex bottoms is provided. The method comprises reacting a feedstream comprising all or a portion of the C9+ aromatic bottoms in the presence of a hydrodearylation catalyst and hydrogen under specified reaction conditions for hydrodearylation to produce at least liquid effluents containing dearylated hydrocarbons. All or a portion of the liquid effluents from hydrodearylation are separated into a BTEX-rich fraction and a solvent fraction. The solvent fraction is recovered.

In some embodiments, the aromatic complex includes a xylene rerun unit, and the feedstream comprises C9+ alkylaromatics from the xylene rerun unit.

In some embodiments, the aromatic complex includes or is in fluid communication with a transalkylation zone for transalkylation of aromatics to produce C8 aromatic compounds and C11+ aromatic compounds, and wherein the all or a portion of the feedstream to hydrodearylation comprises C11+ aromatics from the transalkylation zone.

In some embodiments, the solvent fraction is further separated into a light solvent fraction and a heavy solvent fraction. In some embodiments, all or a portion of the heavy fraction is sent to a fuel oil pool as a fuel oil blending component.

In some embodiments, catalytic reforming is preceded by a naphtha hydrotreating zone. In some embodiments, all or a portion of the BTEX-rich fraction is passed to the aromatic complex. In some embodiments, the aromatic complex includes a reformate splitter operable to separate reformate into light reformate stream and a heavy reformate stream, further comprising passing all or a portion of the BTEX-rich fraction to the reformate splitter. In some embodiments, the aromatic complex includes a reformate splitter operable to separate reformate into light reformate stream and a heavy reformate stream, and a heavy reformate splitter operable to separate heavy reformate into a C7 stream and a C8+ stream, and further comprising passing all or a portion of the BTEX-rich fraction to the heavy reformate splitter. In some embodiments, hydrodearylation is operable to break bridges between rings of alkyl-bridged, non-condensed multi-aromatics contained in the feedstream. In some embodiments, catalytic reforming is preceded by a naphtha hydrotreating zone, and further comprising passing all or a portion of the BTEX-rich fraction to the naphtha hydrotreating zone. In some embodiments, the aromatic complex includes a xylene rerun unit, and wherein the feedstream comprises C9+ alkylaromatics from the xylene rerun unit. In some embodiments, the aromatic complex includes or is in fluid communication with a transalkylation zone for transalkylation of aromatics to produce C8 aromatic compounds and C11+ aromatic compounds, and wherein the all or a portion of the feedstream to hydrodearylation comprises C11+ aromatics from the transalkylation zone.

In some embodiments, the liquid effluents containing dearylated hydrocarbons boils in the range of about 80-450° C. In some embodiments, the solvent fraction has an aniline point of less than or equal to 18° C. In some embodiments, the solvent fraction has a density in the range 0.860-0.990 g/cm$^3$. In some embodiments, the solvent fraction has an aromatic content of at least 95 V %. In some embodiments, the solvent fraction has a sulfur concentration of less than 200 ppmw, less than 150 ppmw, or less than 100 ppmw.

In some embodiments, all or a portion of the BTEX-rich fraction or solvent fraction boiling in the 145-180° C. range is sent to a gasoline pool as a gasoline blending component. In some embodiments, this is a portion of the BTEX-rich fraction that boils in 145-180° C. range. In some embodiments, this is a portion of solvent fraction that boils in 145-180° C. range. In some embodiments, this is a portion of the BTEX-rich fraction and a portion of solvent fraction that boils in 145-180° C. range.

Any combinations of the various embodiments and implementations disclosed herein can be used. These and other aspects and features can be appreciated from the following description of certain embodiments and the accompanying drawings and claims.

DETAILED DESCRIPTION OF CERTAIN EMBODIMENTS OF THE DISCLOSURE

Figure 1:
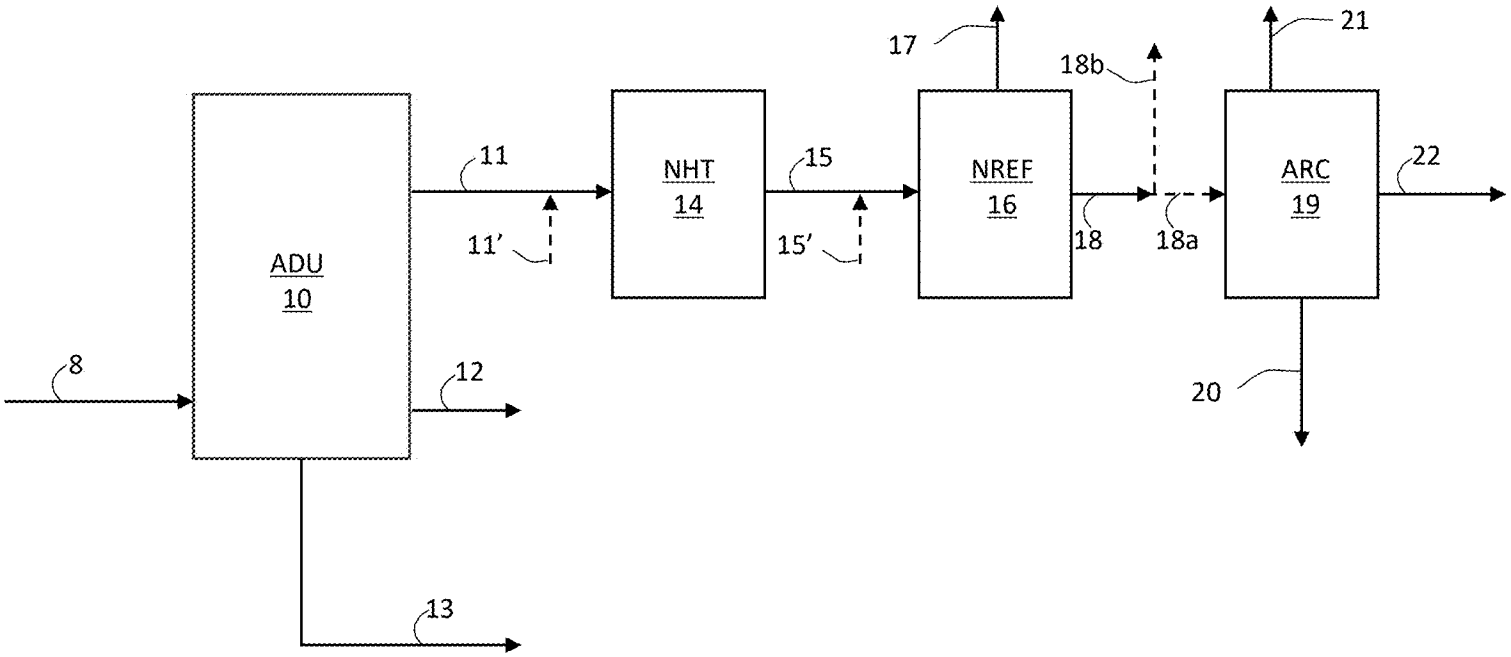
FIG. 1 is a schematic process flow diagram of a refinery system.

As used herein, the term "stream" (and variations of this term, such as hydrocarbon stream, feedstream, product stream, and the like) may include one or more of various hydrocarbon compounds, such as straight chain, branched or cyclical alkanes, alkenes, alkadienes, alkynes, alkylaromatics, alkenyl aromatics, condensed and non-condensed di-, tri- and tetra-aromatics, and gases such as hydrogen and methane, $C_2$+ hydrocarbons and further may include various impurities.

The term "zone" refers to an area including one or more equipment, or one or more sub-zones. Equipment may include one or more reactors or reactor vessels, heaters, heat exchangers, pipes, pumps, compressors, and controllers. Additionally, an equipment, such as reactor, dryer, or vessels, further may be included in one or more zones.

Volume percent or "V %" refers to a relative value at conditions of 1 atmosphere pressure and 15° C.

The phrase "a major portion" with respect to a particular stream or plural streams, or content within a particular stream, means at least about 50 W % and up to 100 W %, or the same values of another specified unit.

The phrase "a significant portion" with respect to a particular stream or plural streams, or content within a particular stream, means at least about 75 W % and up to 100 W %, or the same values of another specified unit.

The phrase "a substantial portion" with respect to a particular stream or plural streams, or content within a particular stream, means at least about 90, 95, 98 or 99 W % and up to 100 W %, or the same values of another specified unit.

The modifying term "straight run" is used herein having its well-known meaning, that is, describing fractions derived directly from the atmospheric distillation unit, optionally subjected to steam stripping, without other refinery treatment such as hydroprocessing, fluid catalytic cracking or steam cracking. An example of this is "straight run naphtha" and its acronym "SRN" which accordingly refers to "naphtha" defined herein that is derived directly from the atmospheric distillation unit, optionally subjected to steam stripping, as is well known.

The term "naphtha" as used herein refers to hydrocarbons boiling in the range of about 20-220, 20-210, 20-200, 20-190, 20-180, 20-170, 32-220, 32-210, 32-200, 32-190, 32-180, 32-170, 36-220, 36-210, 36-200, 36-190, 36-180 or 36-170° C.

The term "heavy naphtha" as used herein refers to hydrocarbons boiling in the range of about 90-220, 90-210, 90-200, 90-190, 90-180, 90-170, 93-220, 93-210, 93-200, 93-190, 93-180, 93-170, 100-220, 100-210, 100-200, 100-190, 100-180, 100-170, 110-220, 110-210, 110-200, 110-190, 110-180 or 110-170° C.

The term "diesel range distillates" as used herein relative to effluents from the atmospheric distillation unit or separation unit refers to middle and heavy distillate hydrocarbons boiling between the end point of the naphtha range and the initial point of the atmospheric residue, such as in the range of about 170-370, 170-360, 170-350, 170-340, 170-320, 180-370, 180-360, 180-350, 180-340, 180-320, 190-370, 190-360, 190-350, 190-340, 190-320, 200-370, 200-360, 200-350, 200-340, 200-320, 210-370, 210-210, 210-350, 210-340, 210-320, 220-370, 220-220, 220-350, 220-340 or 220-320° C.; sub-fractions of middle and heavy distillates include kerosene, diesel and atmospheric gas oil.

The term "atmospheric residue" and its acronym "AR" as used herein refer to the bottom hydrocarbons having an initial boiling point corresponding to the end point of the diesel range distillates, and having an end point based on the characteristics of the crude oil feed.

The term "reformate" as used herein refers to a mixture of hydrocarbons that are rich in aromatics, and are intermediate products in the production of chemicals and/or gasoline, and include hydrocarbons boiling in the range of about 30-220, 40-220, 30-210, 40-210, 30-200, 40-200, 30-185, 40-185, 30-170 or 40-170° C.

The term "light reformate" as used herein refers to hydrocarbons boiling in the range of about 30-110, 30-100, 30-90, 30-88, 40-110, 40-100, 40-90 or 40-88° C.

The term "heavy reformate" as used herein refers to hydrocarbons boiling in the range of about 90-220, 90-210, 90-200, 90-190, 90-180, 90-170, 93-220, 93-210, 93-200, 93-190, 93-180, 93-170, 100-220, 100-210, 100-200, 100-190, 100-180, 100-170, 110-220, 110-210, 110-200, 110-190, 110-180 or 110-170° C.

As used herein, the term "aromatic products" includes $C_6$-$C_8$ aromatics, such as benzene, toluene, mixed xylenes (commonly referred to as BTX), or benzene, toluene, ethylbenzene and mixed xylenes (commonly referred to as BTEX), and any combination thereof. These aromatic products (referred to in combination or in the alternative as BTX/BTEX for convenience herein) have a premium chemical value.

As used herein, the terms "aromatic complex bottoms" and "aromatic bottoms" are used interchangeably and include hydrocarbons that are derived from an aromatic complex. These include the heavier fraction of $C_9$+ aromatics such as $C_9$-$C_{16}$+ compounds, and include a mixture of compounds including di-aromatics, for example in the range of $C_{10}$-$C_{16}$+ aromatic components. For example, aromatic bottoms generally boil in the range of greater than about 110 or 150° C., in certain embodiments in the range of about 110-500, 150-500, 110-450 or 150-450° C.

The term "mixed xylenes" refers to a mixture containing one or more $C_8$ aromatics, including any one of the three isomers of di-methylbenzene and ethylbenzene.

FIG. 1 is a schematic process flow diagram of a system and process for conversion of naphtha into gasoline and aromatic products integrating a naphtha hydrotreating zone 14, a catalytic reforming zone 16 and an aromatic complex 19. The system is shown in the context of a refinery including an atmospheric distillation column 10 having one or more outlets discharging a naphtha fraction 11 such as straight run naphtha, one or more outlets discharging diesel range distillates, shown as stream 12, and one or more outlets discharging an atmospheric residue fraction 13.

Naphtha conversion includes the naphtha hydrotreating zone 14, the catalytic reforming zone 16, and the aromatic complex 19. The naphtha hydrotreating zone 14 includes one or more inlets in fluid communication with the naphtha fraction 11 outlet(s), and one or more outlets discharging a hydrotreated naphtha stream 15. The catalytic reforming zone 16 includes one or more inlets in fluid communication with the hydrotreated naphtha stream 15 outlet(s), one or more outlets discharging a hydrogen rich gas stream 17, and one or more outlets discharging a reformate stream 18. In certain embodiments, the source of naphtha that is passed to the naphtha hydrotreating zone 14 can include a source other than the naphtha fraction 11, which in certain embodiments is straight run naphtha. Such other sources, which can be used instead of or in conjunction with the naphtha fraction 11, are generally indicated in FIG. 1 as stream 11', and can be derived from one or more sources of naphtha such as a wild naphtha stream obtained from a hydrocracking operation, a coker naphtha stream obtained from thermal cracking operations, pyrolysis gasoline obtained from steam cracking operations, or FCC naphtha. In still further embodiments, any naphtha stream that has sufficiently low heteroatom content can be passed directly to the catalytic reforming zone 16, generally indicated in FIG. 1 as stream 15'.

In certain embodiments, a portion 18*b* of the reformate can optionally be used directly as a gasoline blending pool component. All of stream 18, or a portion 18*a* in embodiments where a portion 18*b* is drawn off as a gasoline blending pool component, is used as feed to the aromatic complex 19. In certain embodiments, the portion 18*a* can be a heavy reformate fraction and the portion 18*b* can be a light reformate fraction. The aromatic complex 19 includes one or more inlets in fluid communication with the outlet(s) discharging the reformate stream 18 or the portion 18*a* thereof, and includes one or more outlets discharging gasoline pool stream(s) 21, one or more outlets discharging aromatic products stream(s) 22, and one or more outlets discharging an aromatic bottoms stream 20 that contains $C_9$+ aromatic hydrocarbon compounds.

An initial feed such as crude oil stream 8 is distilled in the atmospheric distillation column 10 to recover a naphtha or a heavy naphtha fraction 11 such as straight run naphtha or straight run heavy naphtha, and other fractions including for instance one or more diesel range distillate fractions, shown as stream 12, and an atmospheric residue fraction 13.

The stream(s) 11 and/or 11' are hydrotreated in the naphtha hydrotreating zone 14 in the presence of hydrogen to produce the hydrotreated stream 15. The naphtha hydrotreating zone 14 operates in the presence of an effective amount of hydrogen, which can be obtained from recycle within the naphtha hydrotreating zone 14, recycle reformer hydrogen 17 (not shown), and if necessary, make-up hydrogen (not shown). A suitable naphtha hydrotreating zone 14 can include systems based on commercially available technology. In certain embodiments the feedstream(s) 11 and/or 11' to the naphtha hydrotreating zone 14 comprises full range naphtha, and the full range of hydrotreated naphtha is passed to the catalytic reforming zone 16. In other embodiments, the feedstream(s) 11 and/or 11' to the naphtha hydrotreating zone 14 comprises heavy naphtha, and hydrotreated heavy naphtha is passed to the catalytic reforming zone 16. In further embodiments, the feedstream(s) 11 and/or 11' to the naphtha hydrotreating zone 14 comprises full range naphtha, the full range of hydrotreated naphtha is passed to a separator between the naphtha hydrotreating zone 14 and the catalytic reforming zone 16 (not shown), and hydrotreated heavy naphtha is passed to the catalytic reforming zone 16.

The streams 15 and/or 15' are passed to the catalytic reforming zone 16, which operates as is known to improve its quality, that is, increase its octane number and produce a reformate stream 18. In addition, the hydrogen rich gas stream 17 is produced, all or a portion of which can optionally be used to meet the hydrogen demand of the naphtha hydrotreating zone 14 (not shown). The reformate stream 18 or a portion 18*a* thereof can be used as a feedstock for the aromatic complex 19. A portion 18*b* of stream 18 can optionally be used directly as a gasoline blending pool component, for instance 0-99, 0-95, 0-90, 0-80, 0-70, 0-60, 0-50, 0-40, 0-30, 0-20 or 0-10 V %. In the aromatic complex 19, a gasoline pool stream 21 is discharged. In certain embodiments the benzene content of the gasoline pool stream 21 is less than or equal to about 3 V % or about 1 V %. In addition, aromatic products are recovered as one or more stream(s) 22.

The naphtha hydrotreating zone 14 is operated under conditions, and utilizes catalyst(s), effective for removal of a significant amount of the sulfur and other known contaminants. Accordingly, the naphtha hydrotreating zone 14 subjects feed to hydrotreating conditions to produce a hydrotreated naphtha or hydrotreated heavy naphtha stream 15 effective as feed to the catalytic reforming zone 16. The naphtha hydrotreating zone 14 operates under conditions of, for example, temperature, pressure, hydrogen partial pressure, liquid hourly space velocity (LHSV), catalyst selection/loading that are effective to remove at least enough sulfur, nitrogen, olefins and other contaminants needed to meet requisite product specifications. For example, the naphtha hydrotreating zone 14 can be operated under conditions effective to produce a naphtha range stream that meets requisite product specifications regarding sulfur and nitrogen levels, for instance, a level of ≤0.5 ppmw, as is conventionally known. Effective naphtha hydrotreating reactor catalysts include those possessing hydrotreating functionality and which generally contain one or more active metal component of metals or metal compounds (oxides or sulfides) selected from the Periodic Table of the Elements IUPAC Groups 6-10. In certain embodiments, the active metal component is selected from the group consisting of Co, Ni, Mo, and combinations thereof. The catalyst used in the naphtha hydrotreating zone 14 can include one or more catalyst selected from Co/Mo, Ni/Mo and Co/Ni/Mo. Combinations of one or more of Co/Mo, Ni/Mo and Co/Ni/Mo, can also be used. In certain embodiments, a Co/Mo hydrodesulfurization catalyst is suitable. The active metal component is typically deposited or otherwise incorporated on a support, such as amorphous or crystalline alumina, silica alumina, titania, zeolites, or combinations thereof. The combinations can be composed of different particles containing a single active metal species, or particles containing multiple active species.

The hydrotreated naphtha stream is treated in the catalytic reforming zone 16 to produce reformate 18. A suitable catalytic reforming zone 16 can include systems based on commercially available technology. In certain embodiments, all, a substantial portion or a significant portion of the hydrotreated naphtha stream 15 is passed to the catalytic reforming zone 16, and any remainder can be blended in a gasoline pool. Typically, within the catalytic reforming zone 16, reactor effluent, containing hot reformate and hydrogen, is cooled and passed to a separator for recovery of a hydrogen stream and a separator bottoms stream, the hydrogen of which is split into a portion that is compressed and recycled within the reformer reactors, and an excess hydrogen stream 17. The separator bottoms stream is passed to a stabilizer column to produce a light end stream and a reformate stream. The light end stream can be recovered and combined with one or more other similar streams obtained in the refinery. The hydrogen stream 17 can be recovered and passed to other hydrogen users within the refinery, including the naphtha hydrotreating zone 14.

In general, operating conditions for reactor(s) in the catalytic reforming zone 16 include a temperature in the range of from about 400-560 or 450-560° C.; a pressure in the range of from about 1-50 or 1-20 bars; and a liquid hourly space velocity in the range of from about 0.5-10, 0.5-4, or 0.5-2 $h^{-1}$. The reformate is sent to the gasoline pool to be blended with other gasoline components to meet the required specifications. Cyclic and CCR process designs include online catalyst regeneration or replacement, and accordingly the lower pressure ranges as indicated above are suitable. For instance, CCRs can operate in the range of about 5 bar, while semi regenerative systems operate at the higher end of the above ranges, with cyclic designs typically operating at a pressure higher than CCRs and lower than semi regenerative systems.

An effective quantity of reforming catalyst is provided. Such catalysts include mono-functional or bi-functional reforming catalysts which generally contain one or more active metal component of metals or metal compounds (oxides or sulfides) selected from the Periodic Table of the Elements IUPAC Groups 8-10. A bi-functional catalyst has both metal sites and acidic sites. In certain embodiments, the active metal component can include one or more of Pt, Re, Au, Pd, Ge, Ni, Ag, Sn, Ir or halides. The active metal component is typically deposited or otherwise incorporated on a support, such as amorphous or crystalline alumina, silica alumina, titania, zeolites, or combinations thereof. In certain embodiments, Pt or Pt-alloy active metal components that are supported on alumina, silica or silica-alumina are effective as reforming catalyst. The hydrocarbon/naphtha feed composition, the impurities present therein, and the desired products will determine such process parameters as choice of catalyst(s), process type, and the like. Types of chemical reactions can be targeted by a selection of catalysts or operating conditions known to those of ordinary skill in the art to influence both the yield and selectivity of conversion of paraffinic and naphthenic hydrocarbon precursors to particular aromatic hydrocarbon structures.

Figure 2:
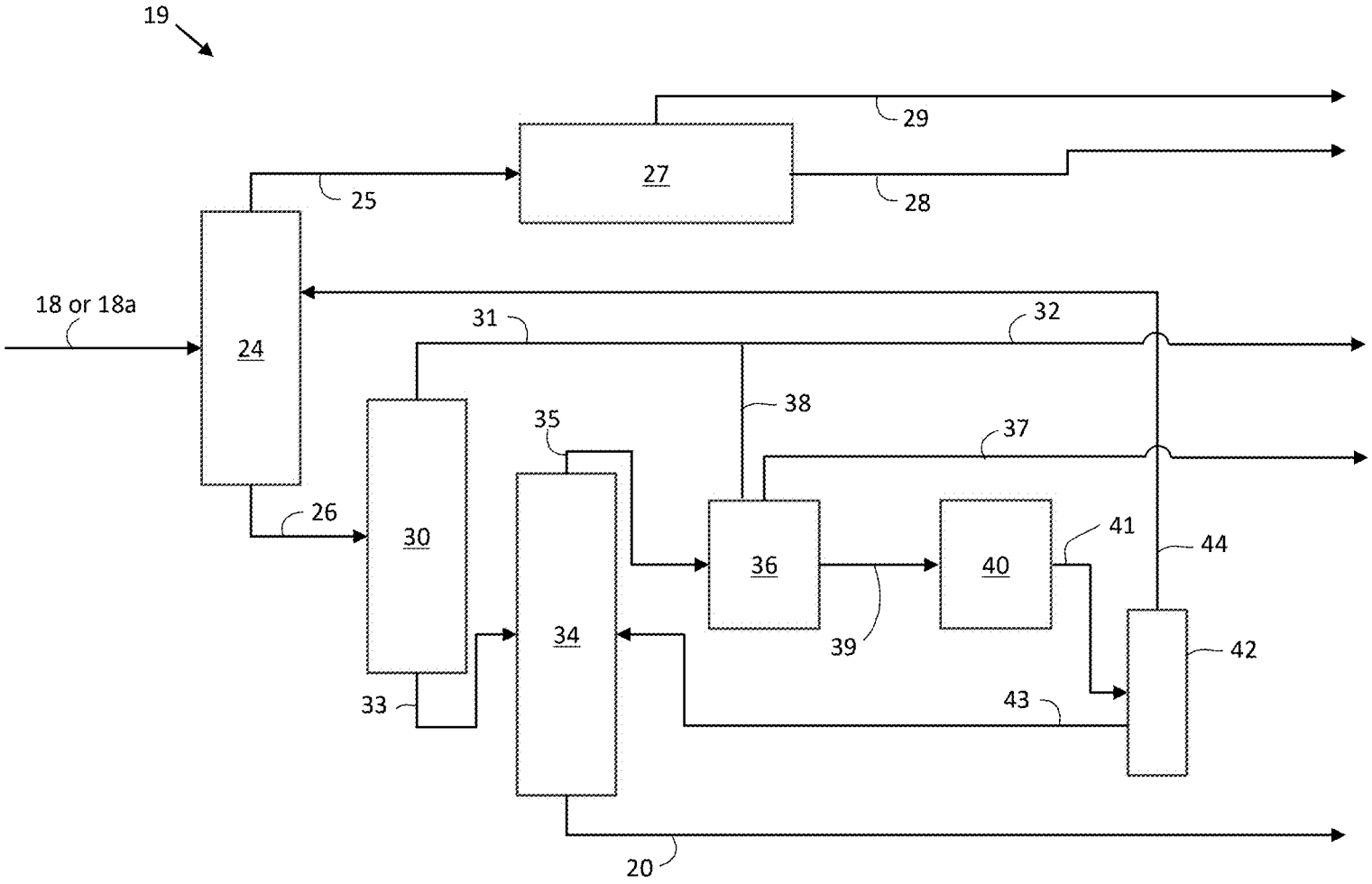
FIG. 2 is a schematic process flow diagram of an aromatics recovery complex.

FIG. 2 is a schematic process flow diagram of an aromatic complex 19. The reformate stream 18 or a portion, stream 18*a*, is passed to the aromatic complex 19 to extract and separate the aromatic products, such as benzene and mixed xylenes, which have a premium chemical value, and to produce an aromatics and benzene-free gasoline blending component. The aromatic complex produces a heavier fraction of $C_9$+ aromatics, stream 20, which is not suitable as a gasoline blending component stream.

In the aromatic complex described in conjunction with FIG. 2, toluene may be included in the gasoline cut, but other embodiments are well known in which toluene is separated and/or further processed to produce other desirable products. For instance, toluene along with $C_9$+ hydrocarbon compounds can be subjected to transalkylation to produce ethylbenzene and mixed xylenes, as disclosed in U.S. Pat. No. 6,958,425, which is incorporated herein by reference.

A reformate stream 18 or portion 18*a* from the catalytic reforming unit 16 is divided into a light reformate stream 25 and a heavy reformate stream 26 in a reformate splitter 24. The light reformate stream 25, containing $C_5/C_6$ hydrocarbons, is sent to a benzene extraction unit 27 to extract a benzene product stream 28 and to recover a gasoline component stream 29 containing non-aromatic $C_5/C_6$ compounds, raffinate motor gasoline, in certain embodiments which is substantially free of benzene. The heavy reformate stream 26, containing $C_7$+ hydrocarbons, is routed to a heavy reformate splitter 30, to recover a $C_7$ component 31 that forms part of a $C_7$ gasoline product stream 32, and a $C_8$+ hydrocarbon stream 33.

The $C_8$+ hydrocarbon stream 33 is routed to a xylene rerun unit 34, where it is separated into a $C_8$ hydrocarbon stream 35 and a heavier $C_9$+ aromatic hydrocarbon stream 20 (for instance which corresponds to the aromatic bottoms stream/$C_9$+ hydrocarbon stream 20 described in FIG. 1). The $C_8$ hydrocarbon stream 35 is routed to a para-xylene extraction unit 36 to recover a para-xylene product stream 37. Para-xylene extraction unit 36 also produces a $C_7$ cut mogas stream 38, which can be combined with $C_7$ cut mogas stream 31 to produce the $C_7$ cut mogas stream 32. A stream 39 of other xylenes (that is, ortho- and meta-xylenes) is recovered and sent to a xylene isomerization unit 40 to produce additional para-xylene, and an isomerization effluent stream 41 is sent to a splitter column 42. A $C_8$+ hydrocarbon stream 43 is recycled back to the para-xylene extraction unit 36 from the splitter column 42 via the xylene rerun unit 34. Splitter tops, $C_7$− hydrocarbon stream 44, is recycled back to the reformate splitter 24. The heavy fraction 20 from the xylene rerun unit 34 is the aromatic bottoms stream that is conventionally recovered as process reject, corresponding to stream 20 in FIG. 1. In certain embodiments, the streams 29 and 32 form the gasoline pool stream 21 as in FIG. 1, and streams 28 and 37 form the aromatic products streams 22.

Figure 3:
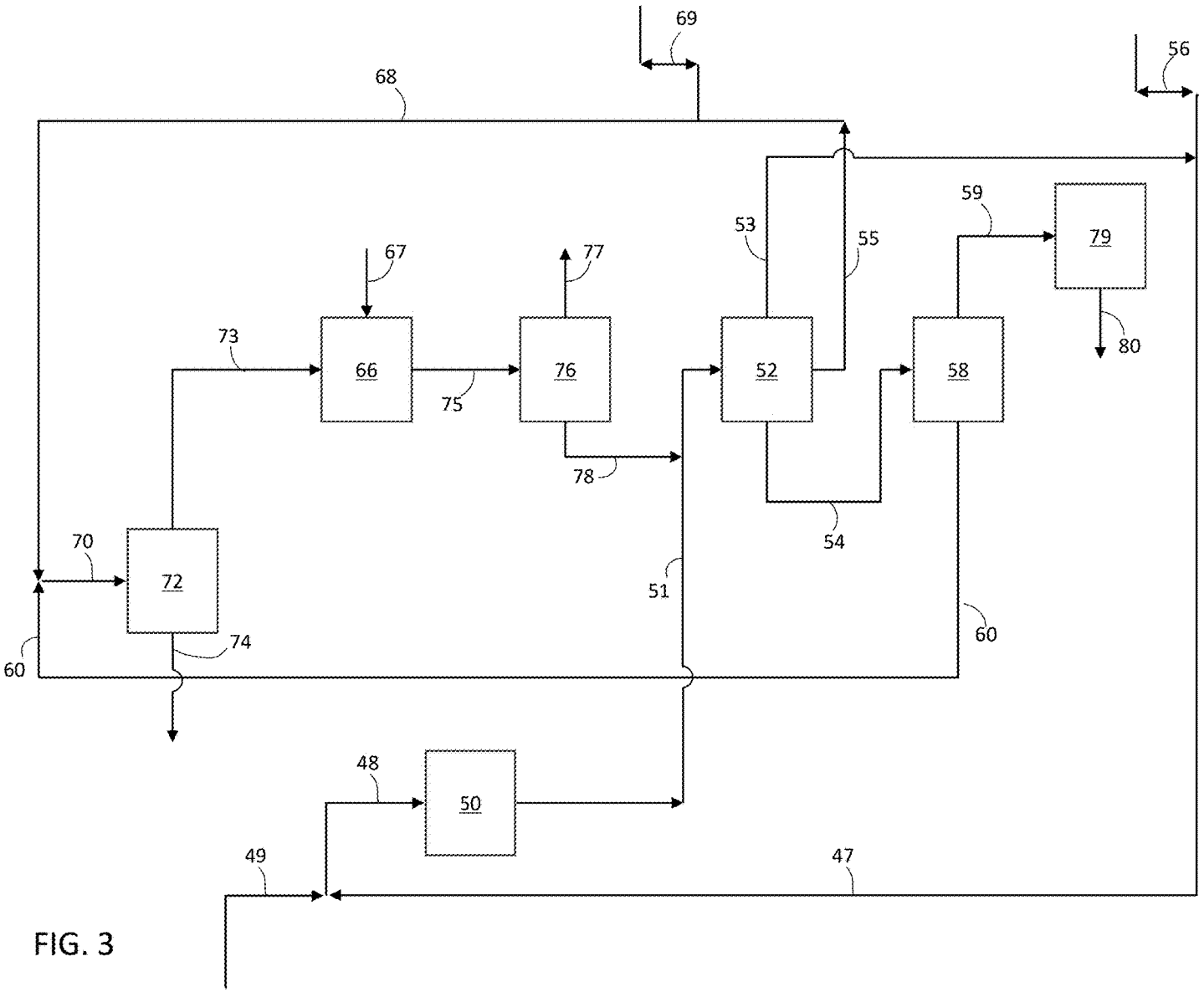
FIG. 3 is a schematic process flow diagram of a system for aromatic transalkylation.

FIG. 3 is a schematic process flow diagram of a transalkylation/toluene disproportionation zone for aromatic transalkylation of $C_9$+ aromatics into $C_8$ aromatics ethylbenzene and xylenes, for instance similar to that disclosed in U.S. Pat. No. 6,958,425. In general, the units of the transalkylation/toluene disproportionation zone operate under conditions and in the presence of catalyst(s) effective to disproportionate toluene and $C_9$+ aromatics. Benzene and/or toluene can be supplied from the integrated system and processed herein or externally as needed. While an example of a transalkylation/toluene disproportionation zone is show in FIG. 3, it is understood that other processes can be used and integrated within the system and process herein for catalytic conversion of aromatic complex bottoms.

A $C_9$+ alkylaromatics feedstream 49 for transalkylation can be all or a portion of stream 20 from the aromatic complex (for instance from the xylene rerun unit). In the process, a $C_9$+ alkylaromatics stream 49 is admixed with a benzene stream 47 to form a combined stream 48 as the feed to a first transalkylation reactor 50 (optionally also including an additional hydrogen stream). After contact with a suitable transalkylation catalyst such as a zeolite material, a first transalkylation effluent stream 51 is produced and passed to a first separation column 52. The separation column 52, which also receives a second transalkylation effluent stream 78, separates the combined stream into an overhead benzene stream 53; a $C_8$+ aromatics bottoms stream 54 including ethylbenzene and xylenes; and a side-cut toluene stream 55. The overhead benzene stream 53 is recycled back to the transalkylation reactor 50 via stream 47 after benzene is removed or added, shown as stream 56. In certain embodiments added benzene includes stream 28 from the aromatic complex in FIG. 2. The $C_8$+ aromatics bottoms stream 54 is passed to a second separation column 58 from which an overhead stream 59 containing ethylbenzene and xylenes is directed to a para-xylene unit 79 to produce a para-xylene stream 80. In certain embodiments the para-xylene unit 79 can operate similar to the para-xylene extraction unit 36, the xylene isomerization unit 40, or both the para-xylene extraction unit 36, the xylene isomerization unit 40. In further embodiments the para-xylene unit 79 can be the para-xylene extraction unit 36, the xylene isomerization unit 40, or both the para-xylene extraction unit 36 and the xylene isomerization unit 40.

A bottoms C9+ alkylaromatics stream 60 is withdrawn from the second separation column 58. The side-cut toluene stream 55 is ultimately passed to a second transalkylation unit 66 via stream 68 after toluene is added or removed, shown as stream 69. In certain embodiments added toluene includes all or a portion of the $C_7$ streams 31 or 38, or the combined stream 32, from the aromatic complex in FIG. 2. The toluene stream 68 is admixed with the bottoms C9+ alkylaromatics stream 60 to form a combined stream 70 that enters a third separation column 72. The separation column 72 separates the combined stream 70 into a bottoms stream 74 of $C_{11}$+ alkylaromatics ("heavies"), and an overhead stream 73 of $C_9$, $C_{10}$ alkylaromatics, and lighter compounds (including $C_7$ alkylaromatics). The overhead stream 73 is directed to a second transalkylation unit 66, along with a hydrogen stream 67. After contact with a transalkylation catalyst, a second transalkylation effluent stream 75 is directed to a stabilizer column 76 from which an overhead stream 77 of light end hydrocarbons ("light-ends gas", generally comprising at least ethane) is recovered, and a bottom stream 78 of the second transalkylation product is directed to the first separation column 52. All, a major portion, a significant portion or a substantial portion of the bottoms stream 74 of $C_{11}$+ alkylaromatics can be passed to an aromatic complex bottoms treatment zone 81 shown and described in conjunction with FIG. 2 described herein.

The bottoms fraction 20 from the aromatic complex 19 is subjected to additional processing steps, and in certain embodiments separation and processing steps, to recover additional aromatic products and/or gasoline blending material. For instance, all or a portion of the $C_9$+ heavy fraction 20 from the xylene re-run unit 34 is converted. In additional embodiments in which transalkylation is incorporated, all or a portion of a bottoms stream 74 of $C_{11}$+ alkylaromatics from the separation column 72 can be processed to recover additional aromatic products and/or gasoline blending material. While FIGS. 1-2, and optionally FIGS. 1-2 in combination with FIG. 3, show embodiments of conventional systems and processes for reforming and separation of aromatic products and gasoline products, $C_9$+ heavy fractions derived from other reforming and separation processes can be suitable as feeds in the systems and processes described herein, for instance, pyrolysis gasoline from steam cracking having condensed aromatics such as naphthalenes.

Characterizations of aromatic complex bottoms show that $C_9$+ mixtures include for example about 75-94 W % of mono-aromatics, about 4-16 W % of di, tri and tetra-aromatics, and about 2-8 W % of other components containing an aromatic ring. The two-plus ring aromatics include alkyl-bridged non-condensed di-aromatics (1), for instance 55-75, 60-70 or 65 W %, and condensed diaromatics (2) as shown below. For the $C_{11}$+ heavy fractions of aromatic complex bottoms, the mixtures include, for example, about 9-15 W % of mono-aromatics, about 68-73 W % of di, tri and tetra-aromatics, and about 12-18 W % of other components containing an aromatic ring.

(1)

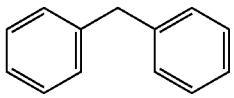

(diphenyl methane)

(2)

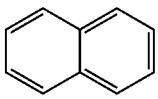

(naphthalene)

Non-condensed diaromatic rings, connected by an alkyl bridge, are commonly formed in the clay treating step prior to the pare-xylene units of the aromatic recovery complex to remove olefins and diolefins. The clay treating process utilizes a clay, which has Lewis acid sites that acts as a catalyst at temperatures of about 200° C. In the process, olefinic molecules such as alkenyl aromatics react with alkylaromatics via a Friedel-Crafts reaction to form molecules having two aromatic rings connected by an alkyl bridge as shown below, (3). In this reaction, styrene reacts with benzene to form diphenylmethane, which is a non-condensed diaromatic molecule:

(3)

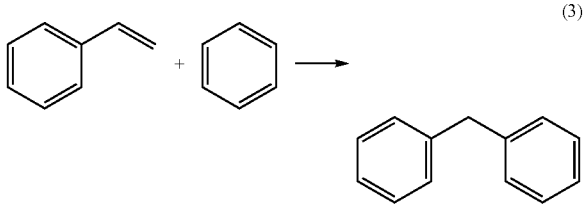

In addition to the alkylation reaction, butyl benzene can be converted to naphthalene, a condensed diaromatic, through cyclization reactions, (4).

(4)

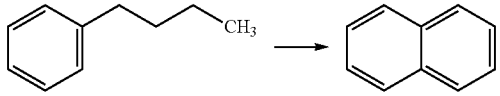

Formation of condensed diaromatics after the clay treaters was also observed. The diaromatic compounds have properties that are not suitable for gasoline blending components. For example, diphenylmethane has a density of 1.01 Kg/L, brown color (Standard Reference Method Color greater than 20), and a boiling point of 264° C. Similarly, naphthalene has a density of 1.14 Kg/L, and a boiling point of 218° C. These properties are not suitable as gasoline blending components.

In a typical refining operation, these multi-aromatics are usually separated from the unreacted alkylaromatics by fractionation, with at least one low-boiling point (or light) fraction containing reduced levels of olefins and at least one high-boiling point (or heavy) fraction containing the multi-aromatics along with high boiling point alkylaromatics. The heavy fraction containing the multi ring-aromatics may be utilized as a stream for gasoline blending because it has a relatively high octane, however the high density, color and boiling point, limit its portion of the blend to relatively low fractions. Where the heavy fraction containing the multi-aromatics is not sent for gasoline blending, it is typically utilized as fuel oil.

The heavy fraction containing the multi ring-aromatics is typically not processed in catalytic units such as a toluene/C9/C10 transalkylation unit, as associated condensed multi-aromatics in the heaviest fractions with greater than 10 carbon atoms tend to form catalyst-deactivating coke layers at the conditions used in such systems, limiting catalyst life between regenerations. Conversion of multi-aromatics into alkylaromatics retains their high octane for gasoline blending, while greatly improving the density, color and boiling point properties. Conversion of the multi-aromatics into alkylaromatics allows for their use as feedstock within BTX/BTEX petrochemicals units directly, or as feedstock to a toluene/C9/C10 transalkylation unit for the fraction of the produced alkylaromatics with carbon numbers greater than C8. Table 1 shows properties and composition of a bottoms stream obtained from an aromatic recovery complex, both where a transalkylation unit is not installed, and where a transalkylation unit is installed. When a transalkylation unit is used, the aromatic bottoms stream was found to have only 15 W % of mono-aromatics and 63 W % diaromatics.

TABLE 1

| Property | | Feedstock - Aromatic Bottoms (no TA) | Tops Gasoline - IBP - 180° C. | Bottoms Distillate - 180° C.+ | Feedstock - Aromatic Bottoms (TA) |
|---|---|---|---|---|---|
| Density | g/cc | 0.8838 | 0.8762 | 0.9181 | 0.9819 |
| Octane Number (ASTM D2799) | | — | 110 | — | — |
| Cetane Index | — | — | — | 12 | — |
| IBP | ° C. | 153 | 67 | 167 | 198 |
| 5 W % | ° C. | 162 | 73 | 176 | 207 |
| 10 W % | ° C. | 163 | 73 | 181 | 211 |
| 30 W % | ° C. | 167 | 76 | 192 | 236 |
| 50 W % | ° C. | 172 | 77 | 199 | 275 |
| 70 W % | ° C. | 176 | 79 | 209 | 303 |
| 90 W % | ° C. | 191 | 81 | 317 | 332 |
| 95 W % | ° C. | 207 | 81 | 333 | 351 |
| FBP | ° C. | 333 | 83 | 422 | 445 |
| Paraffins/naphthenes | W % | 0 | — | — | 0.4 |
| Mono-aromatics | W % | 94.1 | — | — | 15.2 |
| Naphthenic mono-aromatics | W % | 0.9 | — | — | 9.4 |
| Di-aromatics | W % | 3.7 | — | — | 61.3 |
| Naphthenic di-aromatics | W % | 0.9 | — | — | 7.5 |
| Tri+ Aromatics | W % | 0.3 | — | — | 4.5 |

As noted herein, the feed 20 to an aromatic complex bottoms treatment zone 81 can be an aromatic complex bottoms stream or a heavy portion thereof. In certain embodiments the feed to the aromatic complex bottoms treatment zone 81 is undiluted by a solvent. Such feeds can include, single-ring aromatics with at least three additional carbon atoms (for example one 3 carbon alkyl group, three 1 carbon alkyl groups, one 2 carbon alkyl group and one 1 carbon alkyl group, or combinations thereof). In certain embodiments the feed 20 can include a major portion, a significant portion or a substantial portion of such single-ring aromatics with one or more alkyl groups containing three carbon atoms. In addition, the feed 20 can include alkyl bridged non-condensed alkyl multi-aromatic compounds. In certain embodiments the alkyl bridged non-condensed alkylaromatic compounds include at least two benzene rings connected by an alkyl bridge group having at least two carbons, where the benzene rings are connected to different carbons of the alkyl bridge group. In certain embodiments, the alkyl bridged non-condensed alkylaromatic compounds include additional alkyl groups connected to the benzene rings of the alkyl bridged non-condensed alkylaromatic compounds. In certain embodiments, all or a portion of the $C_9$+ heavy fraction 20 from the xylene re-run unit 34 is the feed to the aromatic complex bottoms treatment zone 81. For example, various alkyl bridged non-condensed alkylaromatic compounds may include a mixture of chemical compounds illustrated by formulas (5) (minimum carbon number of 16), (6), (7), and combinations of these compounds.

(5)

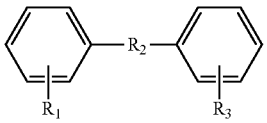

-continued (6)

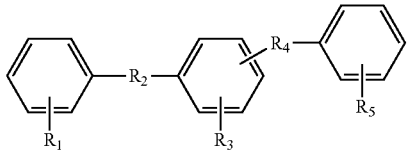

(7)

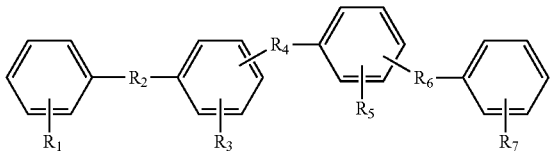

where: $R_2$, $R_4$, and $R_6$ are alkyl bridge groups independently having from two to six carbon atoms; $R_1$, $R_3$, $R_5$, and $R_7$ are independently selected from the group consisting of hydrogen and an alkyl group having from one to eight carbon atoms. In addition to the groups $R_1$, $R_3$, $R_5$, and $R_7$, the benzene groups of formulas (5), (6), and (7) may further include additional alkyl groups connected to the benzene groups, respectively. The total carbon number for non-condensed alkylaromatic compounds of the formula (5) herein is at least 16. In addition to the four benzene groups of formula (7), the various alkyl bridged non-condensed alkylaromatic compounds may include five or more benzene groups connected by alkyl bridges, where the additional benzene groups further may include alkyl groups connected to the additional benzene groups.

Figure 4:
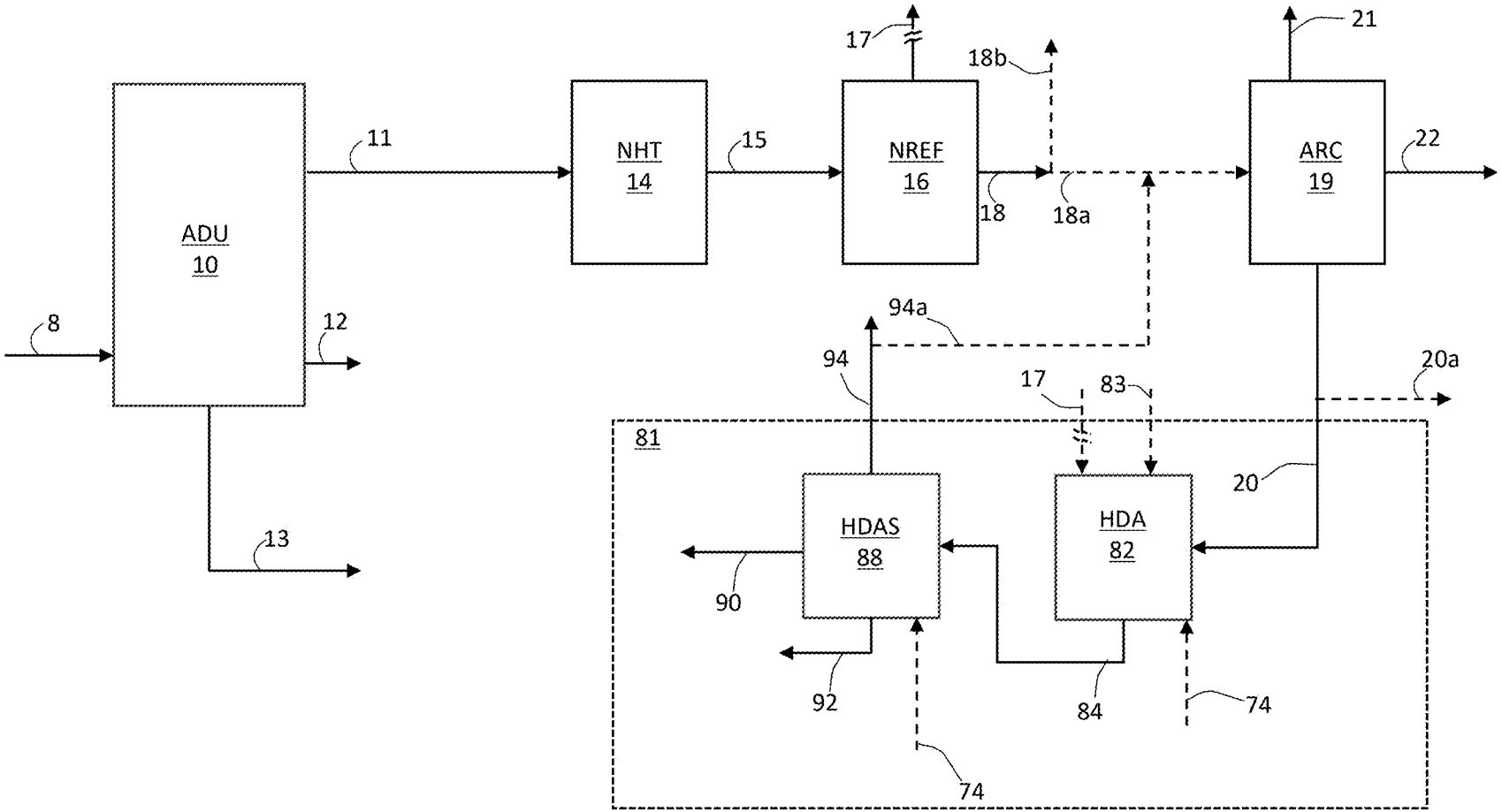
FIG. 4 is a schematic process flow diagram of an embodiment of a system in which aromatic bottoms are separated and passed to a hydrodearylation zone and a hydrodearylation atmospheric separation zone.

With reference to FIG. 4, units and operations similar to FIG. 1 upstream of the aromatic complex 19 are shown, using like reference numerals for like units. FIG. 4 is a schematic process flow diagram of a refinery including conversion of naphtha into gasoline and aromatic products. The refinery includes units similar to those described with respect to FIG. 1: an atmospheric distillation column 10, a naphtha hydrotreating zone 14 and a catalytic reforming zone 16. The aromatic complex 19 is also included that produces the gasoline pool stream(s) 21, the aromatic products stream(s) 22, and the aromatic complex bottoms stream 20. In certain embodiments, a portion of stream 20, shown as stream 20*a* (in dashed lines), is diverted. An aromatic complex bottoms treatment zone 81 is provided to utilize and convert all or a portion of the aromatic complex bottoms stream 20, into additional fuel and/or petrochemical products or blending components or solvents. In certain embodiments, all, a major portion, a significant portion or a substantial portion of the aromatic bottoms stream 20 from the aromatic complex containing $C_9$+ alkylaromatics (for instance from the xylene rerun unit) is passed directly to the aromatic complex bottoms treatment zone 81.

In certain embodiments, for example when a transalkylation and disproportionation zone as in FIG. 3 or similar thereto is used, the aromatic complex bottoms treatment zone 81 is also in fluid communication with the heavies stream 74 (as shown in FIG. 4 in dashed lines).

Treating the bottoms stream from an aromatic complex comprises a multi-step process, including hydrodearylation and hydrodearylation atmospheric separation. In the present processes and systems, aromatic bottoms stream(s) from the aromatic complex containing $C_9$+ alkylaromatics (for instance from a xylene rerun column) and/or $C_{11}$+ aromatics (for instance a bottoms stream from a transalkylation separator), typically considered relatively low-value effluents, are subjected to catalytic hydrodearylation followed by hydrodearylation atmospheric separation. The hydrodearylation atmospheric separation separates the stream into a BTEX-rich fraction and a solvent fraction. The solvent fraction is recovered. This BTEX-rich fraction can be used as a gasoline blending component.

A hydrodearylation (HDA) unit is in fluid communication with the aromatic complex bottoms stream, directly or with an intermediate separator, wherein the HDA unit is operable for hydrodearylation of the aromatic complex bottoms and/or diesel range hydrocarbons derived from the aromatic complex bottoms, and/or a heavy portion thereof, to break the bridge of the alkyl-bridged, non-condensed multi-aromatics.

Hydrodearylation processes are known for the cleaving of the alkyl bridge of non-condensed, alkyl-bridged multi-aromatics or heavy alkylaromatic compounds to form alkyl mono-aromatics, in the presence of a catalyst and hydrogen. For example, U.S. Pat. Nos. 10,053,401 and 10,093,873 disclose passing an aromatics bottoms stream from, for instance, a xylene rerun column of an aromatic complex, to a hydrodearylation unit, despite conventionally limited use as gasoline blending components because of its dark color, high density and high boiling point. Hydrodearylation allows for processing of this low-value stream at relatively mild conditions to yield a higher composition of mono-aromatics and a lower composition of the problematic di-aromatics.

The aromatic complex bottoms treatment zone 81 as shown in FIG. 4 includes an HDA zone 82 and a hydrodearylation separator (HDAS) zone 88. In general, the series of the HDA zone and the HDAS zone units are operable crack diaromatics and to crack alkylaromatics. In certain embodiments, the hydrocarbon feedstock aromatic complex bottoms treatment zone 81 comprises all or a portion of the aromatic complex bottoms stream that is undiluted by a solvent. The conversion includes hydrodearylation to break the bridge between the rings of alkyl-bridged, non-condensed multi-aromatics, breaking the alkyl chains in single ring mono alkylaromatics to produce aromatic products, and ring opening of alkylated mono-naphthenes. The process allows for production of additional aromatic products and/or gasoline blending pool components.

The HDA zone 82 includes one or more reactors operable to treat all or a portion of the aromatic complex bottoms stream by hydrodearylation. In general, the HDA zone 82 includes one or more outlets for discharging an effluent stream 84 containing hydrodearylated hydrocarbons. The reactor(s) include one or more inlets in fluid communication, via a separator or directly, with the aromatic complex bottoms stream. In the embodiment of FIG. 4 the reactor(s) include one or more inlets in fluid communication with the aromatic bottoms stream 20. In additional embodiments in which transalkylation is incorporated, all or a portion of a bottoms stream 74 of $C_{11}$+ alkylaromatics from the separation column 72 is in fluid communication with the HDA zone 82. The HDA zone 82 is in fluid communication with one or more sources of hydrogen including recycled hydrogen from the HDA zone 82, a hydrogen stream 17 from the catalytic reforming zone 16, and/or a hydrogen stream 83 which can be make-up hydrogen from another source.

The outlet(s) of the HDA zone 82 discharge an effluent stream 84 and is in fluid communication with one or more inlets of the HDAS zone 88. The stream 84 includes gases and a liquid effluent mixture containing dearylated hydrocarbons. In certain embodiments (not shown), effluents from the hydrodearylation reaction vessels are cooled in an exchanger and sent to a high pressure cold or hot separator and liquid effluents are passed to the HDAS zone 88.

In additional embodiments in which transalkylation is incorporated, all or a portion of a bottoms stream 74 of $C_{11}$+ alkylaromatics from the separation column 72 is in fluid communication with the HDAS zone 88.

In some embodiments, the liquid effluents containing dearylated hydrocarbons 84 boils in the range of about 80-450, 150-450, 250-450, 350-450, 80-350, 150-350, 250-350, 80-250, 150-250, or 80-150° C.

The HDAS zone 88 separates the effluent stream 84 and has multiple outlets that discharge light solvents 90, heavy solvents 92, and a BTEX rich fraction 94. All or a portion of the BTEX-rich fraction 94 can optionally be recycled back to prior to the aromatic complex 19, as stream 94*a*.

All or a portion of the BTEX-rich fraction 94 can optionally be recycled back to prior to the reformate splitter 24. In some embodiments, the HDAS zone 88 further separates a benzene fraction from the BTEX-rich fraction 94 and all or a portion of the C7+ stream remaining from the BTEX-rich fraction 94 and can optionally be recycled back to be combined with the heavy reformate stream 26. In some embodiments, the HDAS zone 88 further separates a benzene and toluene fraction from the BTEX-rich fraction 94 and all or a portion of the C8+ stream remaining from the BTEX-rich fraction 94 and can optionally be recycled back to be combined with the $C_8$+ hydrocarbon stream 33.

In accordance with embodiments herein, one or more of the light solvents 90 and heavy solvents 92 are recovered from the HDAS zone 88, which may be used in the refinery in which the system herein is implemented, another refinery, or another chemical or petrochemical process.

The feed to the HDA zone 82 contains aromatics including alkylaromatics as a major portion, a significant portion or a substantial portion of its composition. In addition, the feed to the HDA zone 82 contains alkyl-bridged non-condensed di-aromatics and condensed di-aromatic hydrocarbon compounds. The HDA zone 82 is operable to convert aromatics in the liquid effluent from hydrodearylation into naphthenes. In addition, the HDA zone 82 is operable convert alkyl-bridged non-condensed di-aromatics and condensed di-aromatic hydrocarbon compounds that are contained in the feed into mono-aromatic hydrocarbon compounds and mono-naphthenic hydrocarbon compounds. Further, the HDA zone 82 is operable to crack (ring opening) of partially hydrogenated condensed diaromatics (tetralins) to form mono-aromatics.

In operation of the system shown in FIG. 4, the HDA zone 82 receives all or a portion of the aromatic bottoms 20. The aromatic bottoms 20 and hydrogen, are charged to the reactor(s) of the HDA zone 82. In embodiments in which transalkylation is incorporated, all or a portion of a bottoms stream 74 of $C_{11}$+ alkylaromatics from the separation column 72 can be directed to the HDA zone 82. In certain embodiments the bottoms stream 74 is a major portion, a significant portion, a substantial portion feed or all of the feed to the HDA zone 82. Hydrogen is provided in an effective quantity of hydrogen to support the hydrogenation and low pressure hydrocracking of the aromatic compounds in the feed, the reaction conditions, the selected catalysts and other factors, and can be any combination including recycle hydrogen from optional gas separation subsystems (not shown) between the reaction zone and fractionating zone, catalytic reformer hydrogen stream 17, and make-up hydrogen stream 83.

The HDA zone 82 includes an effective reactor configuration with the requisite reaction vessel(s), feed heaters, heat exchangers, hot and/or cold separators, product fractionators, strippers, and/or other units to process the feedstream derived from the aromatic complex bottoms. The HDA zone generally contains one or more fixed-bed, ebullated-bed, slurry-bed, moving bed, continuous stirred tank (CSTR) or tubular reactors, in series or parallel arrangement, which is/are generally operated in the presence of hydrogen under conditions, and utilizes catalyst(s), effective for hydrodearylation of the aromatic complex bottoms or the heavy portion thereof. Additional equipment, including exchangers, furnaces, feed pumps, quench pumps, and compressors to feed the reactor(s) and maintain proper operating conditions, are well known and are considered part of the HDA zone 82. In addition, equipment including pumps, compressors, high temperature separation vessels, low temperature separation vessels and the like to separate reaction products and provide hydrogen recycle within the HDA zone 82, are well known and are considered part of the HDA zone 82.

In certain embodiments, the HDA zone 82 operating conditions include: a reactor temperature (° C.) in the range of from about 150-450, 200-450, 250-450, 150-400, 200-400, 250-400, 150-350, 200-350 or 250-350; a hydrogen partial pressure (bars) in the range of from about 5-50, 10-50, 5-40, 10-40, 5-30, 10-30, 5-25, 10-25, 5-20 or 10-20; a hydrogen gas feed rate (standard liters per liter of hydrocarbon feed, SLt/Lt) up to about 5000, 1000, 500, 300 or 100, in certain embodiments from about 1-5000, 100-5000, 500-5000, 1-1000, 100-1000, 1-500, 100-500, 1-300, 100-500 or 1-100; and a liquid hourly space velocity ($h^{-1}$), on a fresh feed basis relative to the catalysts, in the range of from about 0.5-10.0, 0.5-6.0, 0.5-5.0, 0.5-4.0, 0.5-2.0, 0.8-10.0, 0.8-6.0, 0.8-5.0, 0.8-4.0 or 0.8-2.0.

A suitable hydrodearylation catalyst used in the HDA zone 82 can be one or more conventionally known, commercially available or future developed hydrodearylation catalysts effective to maximize conversion of alkyl-bridged non-condensed di-aromatics and condensed di-aromatic hydrocarbon compounds into mono-aromatic hydrocarbon compounds and mono-naphthenic hydrocarbon compounds. The selection, activity and form of the hydrodearylation catalyst can be determined based on factors including, but not limited to operating conditions, selected reactor configuration, feedstock composition, catalyst composition and desired degree of conversion.

Suitable hydrodearylation catalysts contain one or more active components of metals or metal compounds (oxides, carbides or sulfides) selected from the Periodic Table of the Elements IUPAC Groups 4, 5, 6, 7, 8, 9, 10 and/or 11. In certain embodiments the active components of metals or metal compounds (oxides, carbides or sulfides) are selected from IUPAC Groups 6, 8, 9 and/or 10. In certain embodiments at least two active components of metals or metal compounds (oxides, carbides or sulfides) are provided, including one selected from IUPAC Groups 8, 9 and/or 10, and another from IUPAC Group 6. In certain embodiments the active component of the hydrodearylation catalyst is selected from the group consisting of Fe, Co, Ni, Mo and W. In certain embodiments an active component is selected from the group consisting of Fe, Co and Ni, and a further active component is selected from the group consisting of Mo and W. In certain embodiments two or more of the active components mentioned above are used in the hydrodearylation catalyst.

The active component(s) of the hydrodearylation catalysts are typically deposited or otherwise incorporated on a support such as amorphous or crystalline alumina, γ-alumina, silica-alumina, titania or a combination thereof. In certain embodiments the support of the hydrodearylation catalyst contains about 0.1-80, 0.1-30, 0.1-20, 0.1-15, 0.1-10, 0.5-80, 0.5-30, 0.5-20, 0.5-15, 0.5-10, 1-80, 1-30, 1-20, 1-15, 1-10, 2.5-80, 2.5-30, 2.5-20, 2.5-15, or 2.5-10 W %, of zeolite. The zeolite can be a suitable form of zeolite, including but not limited to one or more of (USY), (*BEA), (FAU), (MFI), (MOR), (MTW) or (MWW) zeolite framework topologies, or another effective form. In certain embodiments the catalyst can include Ni and Mo as active components, on a support of USY zeolite (or another effective form) and one or both of silica-alumina or γ-alumina.

Combinations of active components of the hydrodearylation catalyst can be composed of different particles/granules containing a single active metal species, or particles containing multiple active components. The active components of the hydrodearylation catalyst can be provided in the range of about (W % based on the mass of the active component(s) relative to the total mass of the catalyst) 1-45, 1-35, 1-25, 3-45, 3-35 or 3-25. In certain embodiments the hydrodearylation catalyst contains an IUPAC Groups 8, 9 and/or 10 active component in the range of about (W % based on the mass of the active component(s) relative to the total mass of the catalyst) 1-25, 1-20, 1-15, 2-25, 2-20 or 2-15, and an IUPAC Group 6 active component in the range of about (W % based on the mass of the active component(s) relative to the total mass of the catalyst) 0.5-30, 0.5-25, 0.5-20, 1-30, 1-25, or 1-20. In certain embodiments, the particles of the hydrodearylation have a pore volume in the range of about (cc/gm) 0.15-1.70, 0.15-1.50, 0.30-1.50 or 0.30-1.70; a specific surface area in the range of about ($m^2$/g) 100-450, 100-350, 100-300, 150-450, 150-350, 150-300, 200-450, 200-350 or 200-300; and an average pore diameter of at least about 10, 50, 100, 200, 500 or 1000 angstrom units.

In certain embodiments, the catalyst and/or the catalyst support of the hydrodearylation catalysts is prepared in accordance with U.S. Pat. Nos. 9,221,036 and 10,081,009 (jointly owned by the owner of the present application, and subject to a joint research agreement), which are incorporated herein by reference in their entireties, includes a modified USY zeolite support having one or more of Ti, Zr and/or Hf substituting the aluminum atoms constituting the zeolite framework thereof. For instance, the hydrodearylation catalysts can include an active component carried on a support containing an ultra-stable Y-type zeolite, wherein the above ultra-stable Y-type zeolite is a framework-substituted zeolite (referred to as a framework-substituted zeolite) in which a part of aluminum atoms constituting a zeolite framework thereof is substituted with 0.1-5 mass % zirconium atoms and 0.1-5 mass % titanium ions calculated on an oxide basis.

In certain embodiments, the hydrogen stream to the HDA zone 82 includes a combination of a recycled hydrogen stream and a makeup hydrogen stream. The hydrogen stream can contain at least 70, 80 or 90 mol % hydrogen by weight. In various embodiments, the recycled hydrogen stream may be a stream from the processing of a hydrocarbon product from the reactor. In various embodiments, the recycled hydrogen stream may be combined with the feedstock stream to form a combined feedstock stream that is fed to the reactor. In various embodiments, the hydrogen stream may be combined with the combined feed stream to form a second combined stream that is fed to the reactor. In various embodiments, the recycled hydrogen stream, the make-up hydrogen stream, and the feedstock stream may be combined in any order to form a combined stream that is fed to the reactor. In various embodiments, the recycled hydrogen stream, the make-up hydrogen stream, and the feedstock stream may be fed separately to the reactor or two of the streams may be combined and the other fed separately to the reactor. In various embodiments, the hydrogen stream has a portion of the stream fed directly to one or more catalyst beds of the reactor.

The catalyst may be provided as a catalyst bed in the reactor. In certain embodiments, a portion of the hydrogen stream is fed to the catalyst bed of the reactor to quench the catalyst bed. The catalyst bed may include two or more catalyst beds.

In certain embodiments, the feedstock (either whole or fractionated) to the HDA zone 82 is mixed with an excess of hydrogen gas in a mixing zone. A portion of the hydrogen gas is mixed with the feedstock to produce a hydrogen-enriched liquid hydrocarbon feedstock. This hydrogen-enriched liquid hydrocarbon feedstock and undissolved hydrogen is supplied to a flashing zone in which at least a portion of undissolved hydrogen is flashed, and the hydrogen is recovered and recycled. The hydrogen-enriched liquid hydrocarbon feedstock from the flashing zone is supplied as a feed stream to the HDA zone 82. The HDA liquid product stream that is recovered from the HDA zone 82 is further processed and/or recovered as provided here.

The aromatic complex bottoms treatment zone 81 as shown in FIG. 4 includes an HDAS zone 88 generally operable to separate the hydrodearylation reaction liquid effluent stream 84 into one or more additional product streams from which BTX/BTEX, solvents, and/or suitable gasoline blending components, and other valuable products, are obtained. In some embodiments, the HDAS zone 88 includes a distillation unit. In some embodiments, the HDAS zone 88 includes an atmospheric distillation unit.

HDAS zone 88 separates hydrodearylation reaction liquid effluent stream 84 into light solvents 90, heavy solvents 92, and a BTEX rich fraction 94. In some embodiments (not shown), the light and heavy solvents are recovered as one stream.

In some embodiments, solvents boiling in the distillates range can be recycled back and combined with distillate fraction 12.

In some embodiments, the HDAS zone 88 separates the hydrodearylation reaction liquid effluent stream 84 into a BTEX rich fraction boiling up to about 145° C. and a solvent fraction boiling above about 145° C. In some embodiments, the solvent fraction is separated into a light solvent fraction 90 and a heavy solvent fraction 92, and the light solvent fraction boils in the range of about 145-270° C. and the heavy solvent boils at a temperature greater than about 270° C.

In some embodiments, the HDAS zone 88 separates the hydrodearylation reaction liquid effluent stream 84 into a BTEX rich fraction boiling up to about 180° C. and a solvent fraction boiling above about 180° C. In some embodiments, the solvent fraction is separated into a light solvent fraction 90 and a heavy solvent fraction 92, and the light solvent fraction boils in the range of about 180-270° C. and the heavy solvent boils at a temperature greater than about 270° C.

In some embodiments, the HDAS zone 88 separates the hydrodearylation reaction liquid effluent stream 84 into a BTEX rich fraction boiling up to about 215° C. and a solvent fraction boiling above about 215° C. In some embodiments, the solvent fraction is separated into a light solvent fraction 90 and a heavy solvent fraction 92, and the light solvent fraction boils in the range of about 215-270° C. and the heavy solvent boils at a temperature greater than about 270° C.

In some embodiments, the HDAS zone 88 separates the hydrodearylation reaction liquid effluent stream 84 into a BTEX rich fraction boiling up to about 170° C. and a solvent fraction boiling above about 170° C. In some embodiments, the solvent fraction is separated into a light solvent fraction 90 and a heavy solvent fraction 92, and the light solvent fraction boils in the range of about 170-190° C. and the heavy solvent boils at a temperature greater than about 190° C.

In some embodiments, the HDAS zone 88 separates a BTEX stream comprising C6-C8 hydrocarbons and a solvent stream that comprises C9+ hydrocarbons.

In some embodiments, all or a portion of the BTEX-rich fraction is sent to a gasoline pool as a gasoline blending component (not shown). In some embodiments, all or a portion of the BTEX-rich fraction or solvent fraction boiling in the 145-180° C. range is sent to a gasoline pool as a gasoline blending component (not shown).

In some embodiments, all or a portion of the heavy fraction is sent to a fuel oil pool as a fuel oil blending component (not shown).

In any of the above embodiments, the solvent fraction can be further separated into light solvents 90 and heavy solvents 92.

In some embodiments, the solvent(s) produced and recovered meet predetermined solvent specifications including those pertaining to aromatic content and boiling point, among others. In some embodiments, the aromatic content of the solvents produced is at least 95 V %. In some embodiments, the aromatic content of the solvents produced is in the range of 95-100, 96-100, or 97-100 V %.

In some embodiments, the solvents produced can be used as active solvents to dissolve an ingredient, as diluents for coatings and paints, as an industrial and/or institutional cleaning product, as an adhesive, as a printing ink, or a combination thereof. In some embodiments, a solvent with greater or equal to 95 V % purity is desired. In some embodiments, the solvents produced are similar to those commercially available, for example commercially available by ExxonMobil. Example commercially available ExxonMobil solvents are listed in Table 2.

TABLE 2

| Solvent Name | Units | SA-1000 | SA-1500 | SA-1800 | SA-2000 | SA-3000 |
|---|---|---|---|---|---|---|
| Appearance | | Transparent liquid | | Transparent liquid | | Dark brown liquid |
| Aromatics | V % | 95 | 95 | 95 | 95 | — |
| refractive index (20 C.) | — | | | — | — | 1.585 |
| Distillation IBP | ° C. | 149 | 177 | 200 | 215 | 270 |
| Distillation 50% | ° C. | Report | Report | Report | Report | Report |
| Distillation 90% | ° C. | 180 | 215 | — | — | Report |
| Flash point | ° C. | 38 | 61 | 270 | 300 | — |
| Density @20° C. | ° C. | 0.861-0.878 | 0.877-0.907 | 0.930-0.970 | 0.95 min | 0.990 min |
| Chroma (platinum cobalt scale) | g/cm$^3$ | 10 | 10 | Report | Report | — |
| Copper Corrosion (100° C., 0.5 hours) | | Through | Through | Through | Through | Through |
| Aniline Point | ° C. | 18 | 18 | 18 | 18 | 18 |

In some embodiments, when the demand for aromatics decreases due to market conditions or other factors, the hydrodearylated bottoms can be sold as solvent, providing flexibility to operations.

In some embodiments, the cut point of the HDAS zone is adjusted based on product demand.

In some embodiments, the solvent fraction has an aniline point of less than or equal to 18° C. In some embodiments, the solvent fraction has an aniline point in the range of 10-18, 15-18, or 10-15. In some embodiments, the solvent fraction has a density in the range of 0.860-0.990, 0.860-0.965, or 0.900-0.965 g/cm$^3$. In some embodiments, the solvent fraction has an aromatic content of at least 95 V %. In some embodiments, the aromatic content of the solvent fraction is in the range of 95-100, 96-100, or 97-100 V %. In some embodiments, the solvent fraction has a sulfur concentration of less than 200 ppmw, less than 150 ppmw, or less than 100 ppmw. In some embodiments, the solvent fraction has a sulfur concentration in the range of 0.05-200, 0.5-200, 5-200, 10-200, 0.05-150, 0.5-150, 5-150, 10-150, 0.05-100, 0.5-100, 5-100, or 10-100 ppmw.

The process produces an aromatic rich fraction that is suitable for solvent production. In some embodiments, the products also include BTX, which is not present in the feed. This allows refineries to have options of ways of directing the products as either a gasoline blending component, BTEX, light solvent, etc., and being able to change the cut points of those fractions based on market conditions.

In a first implementation, a process for treatment of $C_9$+ aromatic complex bottoms obtained from catalytic reforming of naphtha followed by separation in an aromatic complex into a gasoline pool stream, an aromatic products stream and the $C_9$+ aromatic complex bottoms, the process comprises reacting a feedstream comprising all or a portion of the $C_9$+ aromatic bottoms in the presence of a hydrodearylation catalyst and hydrogen under specified reaction conditions for hydrodearylation to produce at least liquid effluents containing dearylated hydrocarbons; separating all or a portion of the liquid effluents from hydrodearylation into a BTEX-rich fraction and a solvent fraction, and recovering the solvent fraction.

In a second implementation, the aromatic complex of the first implementation includes a xylene rerun unit, and wherein the feedstream comprises $C_9$+ alkylaromatics from the xylene rerun unit.

In a third implementation, the aromatic complex of the first or second implementation includes or is in fluid communication with a transalkylation zone for transalkylation of aromatics to produce $C_8$ aromatic compounds and $C_{11}$+ aromatic compounds, and wherein the all or a portion of the feedstream to hydrodearylation comprises $C_{11}$+ aromatics from the transalkylation zone.

In a fourth implementation, the hydrodearylation of any of the first through third implementations occurs at a reactor temperature (° C.) in the range of from about 150-450; under a hydrogen partial pressure (bars) in the range of from about 5-50; with a hydrogen gas feed rate (SLt/Lt) of about 500-5000; and at a liquid hourly space velocity ($h^{-1}$), on a fresh feed basis relative to the catalysts, in the range of from about 0.5-10.0.

In a fifth implementation, the hydrodearylation catalysts of any of the first through fourth implementations contains one or more active components selected from a group consisting of Fe, Co, Ni, Mo and W, provided on a support material selected from a group consisting of alumina, silica-alumina, titania, zeolite, and combinations including two or more of the support materials.

In a sixth implementation the BTEX-rich fraction of any of the first through fifth implementations has a boiling point up to about 145° C. and the solvent fraction has a boiling point above 145° C.

In a seventh implementation, the solvent fraction of any of the first through sixth implementations is further separated into a light solvent fraction and a heavy solvent fraction.

In an eighth implementation, the light solvent fraction of the seventh implementation boils in the range of about 145-270° C. and the heavy solvent boils at a temperature greater than about 270° C.

In a ninth implementation, the BTEX-rich fraction of any of the first through fifth implementations has a boiling point up to about 180° C. and the solvent fraction has a boiling point above 180° C.

In a tenth implementation, the solvent fraction from the ninth implementation is further separated into a light solvent fraction and a heavy solvent fraction.

In an eleventh implementation, the light solvent fraction from the tenth implementation boils in the range of about 180-270° C. and the heavy solvent boils at a temperature greater than about 270° C.

In a twelfth implementation, the BTEX-rich fraction of any of the first through fifth implementations has a boiling point up to about 215° C. and the solvent fraction has a boiling point above 215° C.

In a thirteenth implementation, the solvent fraction of the twelfth implementation is further separated into a light solvent fraction and a heavy solvent fraction.

In a fourteenth implementation, the light solvent fraction of the thirteenth implementation boils in the range of about 215-270° C. and the heavy solvent boils at a temperature greater than about 270° C.

In a fifteenth implementation, the BTEX-rich fraction of any of the first through fifth implementations has a boiling point up to about 170° C. and the solvent fraction has a boiling point above 170° C.

In a sixteenth implementation, the solvent fraction of the fifteenth implementation is further separated into a light solvent fraction and a heavy solvent fraction.

In a seventeenth implementation, the light solvent fraction of the sixteenth implementation boils in the range of about 170-190° C. and the heavy solvent boils at a temperature greater than about 190° C.

In an eighteenth implementation all or a portion of the BTEX-rich fraction or solvent fraction of any of the first through seventeenth implementations boiling in the 145-180° C. range is sent to a gasoline pool as a gasoline blending component.

In a nineteenth implementation, all or a portion of the heavy fraction of the seventh, eighth, tenth, eleventh, thirteenth, fourteenth, sixteenth or seventeenth implementation is sent to a fuel oil pool as a fuel oil blending component.

In a twentieth implementation, the catalytic reforming of any of the first through nineteenth implementations is preceded by a naphtha hydrotreating zone.

In a twenty-first implementation, the process any of the first through twentieth implementations further comprises passing all or a portion of the BTEX-rich fraction to the aromatic complex.

In a twenty-second implementation, the aromatic complex of the twenty-first implementation includes a reformate splitter operable to separate reformate into light reformate stream and a heavy reformate stream, further comprising passing all or a portion of the BTEX-rich fraction to the reformate splitter.

In a twenty-third implementation, the aromatic complex of the twenty-first implementation includes a reformate splitter operable to separate reformate into light reformate stream and a heavy reformate stream, and a heavy reformate splitter operable to separate heavy reformate into a $C_7$ stream and a $C_8$+ stream, and further comprising passing all or a portion of the BTEX-rich fraction to the heavy reformate splitter.

In a twenty-fourth implementation, the hydrodearylation of any of the first through twenty-third implementations is operable to break bridges between rings of alkyl-bridged, non-condensed multi-aromatics contained in the feedstream.

In a twenty-fifth implementation, the catalytic reforming of any of the first through twenty-fourth implementations is preceded by a naphtha hydrotreating zone, and further comprising passing all or a portion of the BTEX-rich fraction to the naphtha hydrotreating zone.

In a twenty-sixth implementation, the aromatic complex of any of the first through twenty-fifth implementations includes a xylene rerun unit, and wherein the feedstream comprises $C_9$+ alkylaromatics from the xylene rerun unit.

In a twenty-seventh implementation, the aromatic complex of any of the first through twenty-sixth implementations includes or is in fluid communication with a transalkylation zone for transalkylation of aromatics to produce $C_8$ aromatic compounds and $C_{11}$+ aromatic compounds, and wherein the all or a portion of the feedstream to hydrodearylation comprises $C_{11}$+ aromatics from the transalkylation zone.

In a twenty-eighth implementation, the liquid effluents containing dearylated hydrocarbons of any of the first through twenty-seventh implementations boils in the range of about 80-450° C.

In a twenty-ninth implementation, the solvent fraction of any of the first through twenty-eighth implementations has an aniline point of less than or equal to 18° C.

In a thirtieth implementation, the solvent fraction of any of the first through twenty-ninth implementations has a density in the range 0.860-0.990 g/cm$^3$.

In a thirty-first implementation, the solvent fraction of any of the first through thirtieth implementations has an aromatic content of at least 95 V %.

In a thirty-second implementation, the solvent fraction of any of the first through thirty-first implementations has a sulfur concentration of less than 200 ppmw, less than 150 ppmw, or less than 100 ppmw.

EXAMPLES

The below example and data are exemplary.

A feedstock that was a xylene rerun column bottoms stream with a density of 0.9555 g/cm$^3$, and a sulfur content of 143 ppmw (ASTM D-4294) was reacted in a hydrodearylation reaction zone containing a catalyst comprising nickel and molybdenum with ultra-stable Y-type (USY) zeolite on an alumina support. The HDA was operated at a temperature in the range of 270 to 350° C., at a hydrogen partial pressure of 15 bars, a liquid hourly space velocity of 1.7 hr$^{-1}$. The results of the hydrodearylation reaction are summarized in Table 3.

TABLE 3

| | Feed | Run 1 | Run 2 | Run 3 | Run 4 | Run 5 |
|---|---|---|---|---|---|---|
| Pressure, bars | 0 | 15 | 15 | 15 | 15 | 15 |
| Temperature, ° C. | 0 | 270 | 290 | 310 | 330 | 350 |
| Paraffins, wt. % | 0.18 | 0.56 | 0.66 | 0.64 | 0.68 | 0.66 |
| Aromatics, wt. % | 99.82 | 99.44 | 99.34 | 99.36 | 99.32 | 99.34 |
| Sulfur, ppmw | 143 | 72 | 70 | 66 | — | 69 |
| Density, g/cm$^3$ | 0.9555 | 0.9496 | 0.9472 | 0.9455 | 0.9452 | 0.9439 |
| Initial boiling point, ° C. | 184 | 112 | 112 | 109 | 106 | 96 |
| Final boiling point, ° C. | 397 | 442 | 435 | 438 | 442 | 436 |

The hydrodearylation reaction liquid effluent stream is effective to send to a hydrodearylation separator as described herein for separation into various fractions, for example, a BTEX rich fraction that has a boiling point of up to 145° C., a stream boiling in the range of 145-180° C., a light solvent stream boiling in the range of 180-270° C., and a heavy solvent stream boiling in the range of 270+° C. The BTEX rich fraction will be recycled (for example, as stream 94*a* described herein) to an aromatics complex. The stream boiling in the range of 145-180° C. is effective as a gasoline pool component. The recovered light solvent stream and heavy solvent stream are effective as solvents for use within the refinery or in another chemical or petrochemical process.

It is to be understood that the terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "including," "comprising," or "having," "containing," "involving," and variations thereof herein, when used in this specification, specify the presence of stated features, integers, steps, operations, elements, and/or components, but do not preclude the presence or addition of one or more other features, integers, steps, operations, elements, components, and/or groups thereof.

Notably, the figures and examples above are not meant to limit the scope of the present disclosure to a single implementation, as other implementations are possible by way of interchange of some or all the described or illustrated elements. Moreover, where certain elements of the present disclosure can be partially or fully implemented using known components, only those portions of such known components that are necessary for an understanding of the present disclosure are described, and detailed descriptions of other portions of such known components are omitted so as not to obscure the disclosure. In the present specification, an implementation showing a singular component should not necessarily be limited to other implementations including a plurality of the same component, and vice-versa, unless explicitly stated otherwise herein. Moreover, applicants do not intend for any term in the specification or claims to be ascribed an uncommon or special meaning unless explicitly set forth as such. Further, the present disclosure encompasses present and future known equivalents to the known components referred to herein by way of illustration.

The foregoing description of the specific implementations will so fully reveal the general nature of the disclosure that others can, by applying knowledge within the skill of the relevant art(s), readily modify and/or adapt for various applications such specific implementations, without undue experimentation, without departing from the general concept of the present disclosure. Such adaptations and modifications are therefore intended to be within the meaning and range of equivalents of the disclosed implementations, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance presented herein, in combination with the knowledge of one skilled in the relevant art(s). It is to be understood that dimensions discussed or shown are drawings accordingly to one example and other dimensions can be used without departing from the disclosure.

The subject matter described above is provided by way of illustration only and should not be construed as limiting. Various modifications and changes can be made to the subject matter described herein without following the example embodiments and applications illustrated and described, and without departing from the true spirit and scope of the invention encompassed by the present disclosure, which is defined by the set of recitations in the following claims and by structures and functions or steps which are equivalent to these recitations.

What is claimed is:

1. A process for treatment of $C_9$+ aromatic complex bottoms obtained from catalytic reforming of naphtha followed by separation in an aromatic complex into a gasoline pool stream, an aromatic products stream and the $C_9$+ aromatic complex bottoms, the process comprising:

reacting a feedstream comprising all or a portion of the $C_9$+ aromatic complex bottoms in the presence of a hydrodearylation catalyst and hydrogen under specified reaction conditions for hydrodearylation to produce at least liquid effluents containing dearylated hydrocarbons;

separating all or a portion of the liquid effluents from hydrodearylation into a BTEX-rich fraction and a solvent fraction, and recovering the solvent fraction, wherein the solvent fraction has an aniline point of in the range of 10-18° C., a density in the range 0.860-0.990 g/cm$^3$, an aromatic content in the range of 95-100 V %, a sulfur concentration of less than 100 ppmw.

2. The process as in claim 1, wherein the aromatic complex includes a xylene rerun unit, and wherein the feedstream comprises $C_9$+ alkylaromatics from the xylene rerun unit.

3. The process as in claim 1, further wherein the aromatic complex includes or is in fluid communication with a transalkylation zone for transalkylation of aromatics to produce $C_8$ aromatic compounds and $C_{11}$+ aromatic compounds, and wherein the all or a portion of the feedstream to hydrodearylation comprises $C_{11}$+ aromatics from the transalkylation zone.

4. The process as in claim 1, wherein hydrodearylation occurs:

at a reactor temperature (° C.) in the range of from about 150-450;

under a hydrogen partial pressure (bars) in the range of from about 5-50;

with a hydrogen gas feed rate (SLt/Lt) of about 500-5000; and a liquid hourly space velocity ($h^{-1}$), on a fresh feed basis relative to the catalysts, in the range of from about 0.5-10.0.

5. The process as in claim 1, wherein the hydrodearylation catalysts contains one or more active components selected from a group consisting of Fe, Co, Ni, Mo and W, provided on a support material selected from a group consisting of alumina, silica-alumina, titania, zeolite, and combinations including two or more of the support materials.

6. The process as in claim 1, wherein the BTEX-rich fraction has a boiling point up to about 145° C. and the solvent fraction has a boiling point above 145° C., or the BTEX-rich fraction has a boiling point up to about 180° C. and the solvent fraction has a boiling point above 180° C., or the BTEX-rich fraction has a boiling point up to about 215° C. and the solvent fraction has a boiling point above 215° C., or the BTEX-rich fraction has a boiling point up to about 170° C. and the solvent fraction has a boiling point above 170° C.

7. The process as in claim 6, wherein the solvent fraction is further separated into a light solvent fraction and a heavy solvent fraction.

8. The process as in claim 7, wherein all or a portion of the heavy fraction is sent to a fuel oil pool as a fuel oil blending component.

9. The process as in claim 1, wherein the BTEX-rich fraction has a boiling point up to about 180° C. and the solvent fraction has a boiling point above 180° C.

10. The process as in claim 1, wherein all or a portion of the BTEX-rich fraction or solvent fraction boiling in the 145-180° C. range is sent to a gasoline pool as a gasoline blending component.

11. The process as in claim 1, wherein catalytic reforming is preceded by a naphtha hydrotreating zone.

12. The process as in claim 1, further comprising passing all or a portion of the BTEX-rich fraction to the aromatic complex.

13. The process as in claim 12, wherein the aromatic complex includes a reformate splitter operable to separate reformate into light reformate stream and a heavy reformate stream, further comprising passing all or a portion of the BTEX-rich fraction to the reformate splitter.

14. The process as in claim 12, wherein the aromatic complex includes a reformate splitter operable to separate reformate into light reformate stream and a heavy reformate stream, and a heavy reformate splitter operable to separate heavy reformate into a $C_7$ stream and a $C_8$+ stream, and further comprising passing all or a portion of the BTEX-rich fraction to the heavy reformate splitter.

15. The process as in claim 1, wherein hydrodearylation is operable to break bridges between rings of alkyl-bridged, non-condensed multi-aromatics contained in the feedstream.

16. The process as in claim 1, wherein catalytic reforming is preceded by a naphtha hydrotreating zone, and further comprising passing all or a portion of the BTEX-rich fraction to the naphtha hydrotreating zone.

17. The process as in claim 1, wherein the liquid effluents containing dearylated hydrocarbons boils in the range of about 80-450° C.

18. The process as in claim 1, wherein the hydrodearylation removes non-condensed multi-aromatics from the C9+ aromatic complex bottoms liquid to produce effluents containing mono-aromatic dearylated hydrocarbons.

* * * * *